US009597883B2

(12) United States Patent
Kudo et al.

(10) Patent No.: US 9,597,883 B2
(45) Date of Patent: Mar. 21, 2017

(54) LIQUID STORING BODY

(71) Applicant: SEIKO EPSON CORPORATION, Tokyo (JP)

(72) Inventors: Shoma Kudo, Shiojiri (JP); Koji Nishimaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/066,682

(22) Filed: Mar. 10, 2016

(65) Prior Publication Data

US 2016/0263901 A1 Sep. 15, 2016

(30) Foreign Application Priority Data

Mar. 12, 2015 (JP) ..... 2015-049521

(51) Int. Cl.
*B41J 2/175* (2006.01)
*B41J 29/02* (2006.01)

(52) U.S. Cl.
CPC ..... *B41J 2/1752* (2013.01); *B41J 2/17509* (2013.01); *B41J 29/02* (2013.01)

(58) Field of Classification Search
CPC .... B41J 2/175; B41J 2/17503; B41J 2/17506; B41J 2/1752; B41J 2/17523; B41J 2/17566; B41J 29/02
See application file for complete search history.

(56) References Cited

U.S. PATENT DOCUMENTS 7,607,769 B2 * 10/2009 Umeda ..... B41J 2/1752 347/85
8,596,735 B2 * 12/2013 Koganehira ..... B41J 2/17509 347/7
8,678,567 B2 * 3/2014 Shimizu ..... B41J 2/17523 347/85
9,144,985 B2 * 9/2015 Koike ..... B41J 2/175
2014/0043408 A1 * 2/2014 Kudo ..... B41J 2/175 347/86

FOREIGN PATENT DOCUMENTS

JP 2015-051328 A1 3/2012

* cited by examiner

*Primary Examiner* — Anh T. N. Vo
(74) *Attorney, Agent, or Firm* — Foley & Lardner LLP

(57) ABSTRACT

An advantage of the present invention lies in reducing the likelihood that a cover will open needlessly. A liquid container unit for supplying a liquid to a liquid consuming apparatus includes: a liquid container, a case body, a cover that includes a rotation mechanism, and a locking mechanism configured to hold a closed state. The rotation mechanism includes: a first rotation portion configured to engage with the case body; and a second rotation portion configured to engage with the case body at a position located farther from the locking mechanism than the first rotation portion is in a rotation axis direction of the rotation mechanism, and a second length of an engaging portion at which the case body and the second rotation portion are engaged is longer than a first length of an engaging portion at which the case body and the first rotation portion are engaged.

11 Claims, 19 Drawing Sheets

LIQUID STORING BODY

Priority is claimed under 35 U.S.C. §119 to Japanese Application No. 2015-049521 filed on Mar. 12, 2015 which is hereby incorporated by reference in its entirety.

BACKGROUND

1. Technical Field

The present invention relates to a technique for a liquid container unit including a liquid container and a case containing the liquid container.

2. Related Art

Heretofore, an ink tank unit including an ink tank that has an ink injection port and can contain ink, and a case containing the ink tank is known (e.g., JP-A-2012-51328). A case disclosed in JP-A-2012-51328 includes an upper surface cover that can be opened and closed.

With a technique of including an ink injection port as in previous techniques, various inconveniences have occurred in some cases. For example, there have been cases where if a case includes an upper surface cover, the upper surface cover is opened at a time other than when it is necessary, such as when injecting ink into the ink tank. Also, with previous techniques, there have been cases where the upper surface cover comes off of the case body. In such cases, the ink tank is exposed, and therefore inconveniences such as the ink tank being broken or the ink inside of the ink tank flying out of the case from the ink injection port due to shock being directly applied to the ink tank, for example, can occur. Also, when the ink injection port is exposed, there is a possibility that a user will unintentionally touch the ink injection port. Also, when the upper surface cover is opened or closed, for example, there is a possibility that the upper surface cover will get in the way of another constituent member. Also, when ink is injected into the ink tank through the ink injection port for example, the ink sometimes mistakenly flies out to the periphery of the ink injection port.

This kind of problem is not limited to an ink tank unit including an ink tank and a case containing the ink tank, but is shared by a liquid container unit including a liquid container that has a liquid injection port and can contain a liquid, and a case containing the liquid container. Also, with previous techniques, reduced cost, resource saving, simpler manufacturing, improvements in usability, and the like are desired.

SUMMARY

The invention can be realized as the following embodiments or application examples.

(1) According to an aspect of the invention, a liquid container unit for supplying a liquid to a liquid consuming apparatus is provided. The liquid container unit includes: a liquid container including a liquid containing portion configured to contain the liquid to be supplied to the liquid consuming apparatus, and a liquid injection port through which the liquid is injected into the liquid containing portion; a case body configured to contain the liquid container such that at least a portion of the liquid injection port is located outside; a cover that includes a rotation mechanism, is attached to the case body so as to be able to open and close by means of the rotation mechanism, and covers the liquid injection port in a closed state; and a locking mechanism configured to hold the closed state by means of locking. The rotation mechanism includes: a first rotation portion configured to engage with the case body; and a second rotation portion configured to engage with the case body at a position located farther from the locking mechanism than the first rotation portion is in a rotation axis direction of the rotation mechanism, and a second length of an engaging portion at which the case body and the second rotation portion are engaged is longer than a first length of an engaging portion at which the case body and the first rotation portion are engaged.

According to this aspect, the state in which the cover is closed can be held by the locking mechanism, and it is therefore possible to reduce the likelihood that the cover will open needlessly. Also, since the second length is longer than the first length, it is possible to reduce the likelihood that the engagement between the rotation mechanism and the case body will be removed when the state in which the cover is closed is being held by the locking mechanism. Accordingly, it is possible to reduce the likelihood that the cover will come off of the case body.

(2) The liquid container unit according to the above-described aspect may include an attachment mechanism for detachably attaching a free end of the cover located on a side opposite to a side on which the rotation mechanism is located to the case body. According to this aspect, the state in which the cover is closed can be favorably held by the attachment mechanism.

(3) With the liquid container unit according to the above-described aspect, the attachment mechanism may include a case body-side attachment portion provided on the case body and a cover-side attachment portion that is provided on the free end of the cover and is fastened to the case body-side attachment portion. According to this aspect, the state in which the cover is closed can be more favorably held due to the cover-side attachment portion being fastened to the case body-side attachment portion.

(4) The liquid container unit according to the above-described aspect may furthermore include an open state holding mechanism configured to hold a state in which the cover is open. According to this aspect, the state in which the cover is open can be held by the open state holding mechanism.

(5) With the liquid container unit according to the above-described aspect, the open state holding mechanism may include: a cover-side fastening portion provided on the cover; and a protruding case body-side fastening portion that is provided on the case body, is configured to hold the state in which the case body is open due to the cover-side fastening portion being fastened thereto, and includes a peak portion, and a first portion and a second portion that are positioned so as to sandwich the peak portion in the rotation direction of the rotation mechanism, and when the rotation mechanism is rotated from the state in which the cover is closed to the state in which the cover is open, the cover-side fastening portion moves from the first portion side to the second portion side past the peak portion and is fastened to the second portion, and thus the state in which the cover is open is held. According to this aspect, the state in which the cover is open can be held due to the cover-side fastening portion being fastened to the second portion of the case body-side fastening portion.

(6) With the liquid container unit according to the above-described aspect, one rotation portion of the first rotation portion and the second rotation portion may include the cover-side fastening portion, the open state holding mechanism may include: the first and second rotation portions; and a displacement portion that is provided on the case body and is configured to, when the rotation mechanism rotates from the state in which the cover is closed to the state in which the cover is open, displace the rotation mechanism from the other above-referenced rotation portion side to the one rotation portion side in the rotation axis direction, the displacement portion may have a protruding shape that protrudes from the other above-referenced rotation portion to the one rotation portion in the rotation axis direction, and letting a direction in which the rotation mechanism rotates from the state in which the cover is closed to the state in which the cover is open be an opening direction, when the rotation mechanism rotates in the opening direction, a portion of the other above-mentioned rotation portion may move onto the displacement portion, whereby the rotation mechanism is displaced from the other above-mentioned rotation portion side to the one rotation portion side in the rotation axis direction, and the cover-side fastening portion moves from the first portion side to the second portion side past the peak portion while being pressed to the case body-side fastening portion by the displacement of the rotation mechanism so as to be fastened to the second portion. According to this aspect, the state in which the cover is open can be held due to the cover-side fastening portion being fastened to the second portion of the case body-side fastening portion.

(7) According to another aspect of the invention, a liquid container unit for supplying a liquid to a liquid consuming apparatus is provided. The liquid container unit includes: a liquid container including a liquid containing portion configured to contain the liquid to be supplied to the liquid consuming apparatus, and a liquid injection port through which the liquid is injected into the liquid containing portion; a case body configured to contain the liquid container such that at least a portion of the liquid injection port is located outside (exposed); and a cover that includes a rotation mechanism, is attached to the case body so as to be able to open and close by means of the rotation mechanism, and covers the liquid injection port in a closed state. The case body includes a visual checking portion that is located on a first side with respect to the liquid injection port in a direction along a predetermined direction, and according to which a liquid surface in the liquid containing portion is visible from outside, and the rotation mechanism is located on a second side that is opposite to the first side, such that the liquid injection port is sandwiched in the direction along the predetermined direction.

According to this aspect, the rotation mechanism is located on the second side that is opposite to the first side on which the visual checking portion is located, such that the liquid injection port is sandwiched in the direction along the predetermined direction. Accordingly, it is possible to reduce the likelihood that the visual checking portion will be covered by the cover, regardless of whether the cover is in the open or closed state. Accordingly, when injecting the liquid, the liquid can be injected while the liquid surface is checked through the visual checking portion.

(8) According to another aspect of the invention, a liquid container unit for supplying a liquid to a liquid consuming apparatus is provided. The liquid container unit includes: a liquid container including a liquid containing portion configured to contain the liquid to be supplied to the liquid consuming apparatus, and a liquid injection port through which the liquid is injected into the liquid containing portion; a case body configured to contain the liquid container such that at least a portion of the liquid injection port is located outside (exposed); and a cover that includes a rotation mechanism, is attached to the case body so as to be able to open and close by means of the rotation mechanism, and covers the liquid injection port in a closed state. The rotation mechanism is located below the liquid injection port in a liquid injection state of the liquid container unit when a liquid is injected into the liquid containing portion through the liquid injection port.

According to this aspect, when the cover is opened and liquid is injected into the liquid containing portion through the liquid injection port, liquid that flies out to the periphery of the liquid injection port can be received by the cover.

(9) With the liquid container unit according to the above-described aspect, the cover may include a liquid holding portion.

According to this aspect, liquid that has flown out can be held by the liquid holding portion also in the case where the liquid flies out to the cover.

(10) With the liquid container unit according to the above-described aspect, the cover may include a plug member configured to tightly close the liquid injection port on a side opposing the liquid injection port of the cover.

According to this aspect, due to the cover including the plug member, it is possible to reduce the likelihood that the plug member will be lost.

Not all of the constituent elements included in the above-described aspects of the invention are essential, and a portion of the above constituent elements can be modified, omitted, replaced with other new constituent elements, or have a portion of their limiting content omitted as appropriate in order to resolve a portion or all of the foregoing problems, or in order to achieve a portion or all of the effects described in the present specification. Moreover, it is also possible to combine a portion or all of the technical features included in an above-described aspect of the invention with a portion or all of the technical features included in another above-described aspect of the invention as an independent aspect of the invention in order to resolve a portion or all of the foregoing problems, or in order to achieve a portion or all of the effects described in the present specification.

For example, an aspect of the invention can also be realized as an apparatus including one or more of multiple elements, namely the liquid container, the case body, the cover, and the locking mechanism. In other words, this apparatus may include the liquid container, but it is not necessary. Also, this apparatus may include the case body, but it is not necessary. Also, this apparatus may include the cover, but it is not necessary. Also, this apparatus may include the locking mechanism, but it is not necessary. According to such an aspect, at least one of various problems, such as reducing the size of the apparatus, lowering the cost, saving resources, simplifying manufacturing, and improving usability, can be resolved. Also, a portion or all of the technical features of the aspects of the above-described liquid container unit can all be applied to such a device.

Note that the invention can be realized with various embodiments, and can be realized in modes such as those of a liquid container unit, a liquid consumption system including a liquid container unit and a liquid consuming apparatus, and a case member that contains a liquid container.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
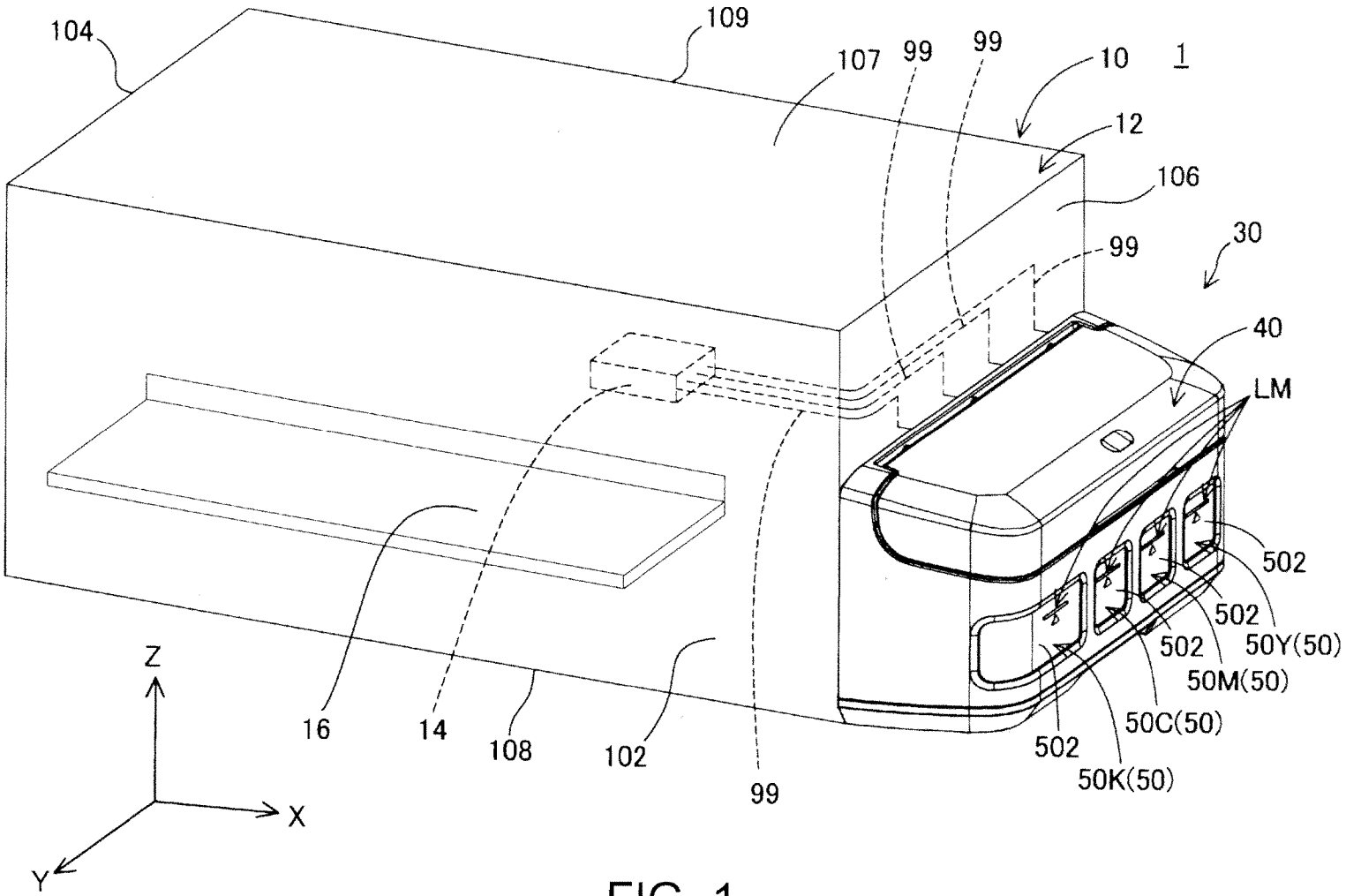
FIG. 1 is an exterior view of a liquid consumption system serving as a first embodiment.

FIG. 1 is an exterior view of a liquid consumption system 1 serving as a first embodiment of the invention. FIG. 1 includes X, Y, and Z axes, which are orthogonal to each other. Note that the X, Y, and Z axes corresponding to FIG. 1 are included as necessary in the other drawings as well.

The liquid consumption system 1 includes a printer 10 serving as a liquid consuming apparatus, and a liquid container unit 30. In a usage state of the liquid consumption system 1, the printer 10 and the liquid container unit 30 are installed on a horizontal plane defined by the X axis direction and the Y axis direction. That is, the Z axis direction is the vertical direction (up-down direction). Also, the −Z axis direction is the vertical downward direction and the +Z axis direction is the vertical upward direction.

The printer 10 is an inkjet printer. The printer 10 includes a recording head 14 that discharges ink serving as a liquid onto a recording medium such as a sheet, and a housing 12 inside of which the recording head 14 is contained. The housing 12 is in the form of an approximate rectangular parallelepiped. The housing 12 includes a front surface (first surface, first wall) 102, a left side surface (second surface, second wall) 104, a right side surface (third surface, third wall) 106, an upper surface (fourth surface, fourth wall) 107, a bottom surface (fifth surface, fifth wall) 108, and a rear surface (sixth surface, sixth wall) 109. The surfaces 102, 104, 106, 107, 108, and 109 constitute the housing 12, which is the outer shell of the printer 10. The front surface 102 is provided with a discharge tray 16 to which a recording medium such as a sheet is discharged.

The front surface 102 and the rear surface 109 oppose each other. The left side surface 104 and the right side surface 106 oppose each other. The front surface 102, the rear surface 109, the left side surface 104, and the right side surface 106 are surfaces that are approximately perpendicular to the installation surface of the printer 10. The upper surface 107 and the bottom surface 108 oppose each other. The upper surface 107 and the bottom surface 108 are surfaces that are approximately horizontal with respect to the installation surface of the printer. The left side surface 104 and the right side surface 106 intersect with the front surface 102 and the rear surface 109. Here, "approximately vertical" and "approximately horizontal" include the sense of being roughly "vertical" or "horizontal", as well as the sense of being perfectly "vertical" or "horizontal". In other words, since the surfaces 102, 104, 106, 107, 108, and 109 are not perfect planes and include unevenness, and the like, it is sufficient that they are roughly "vertical" or roughly "horizontal" in an external view.

The direction in which the left side surface 104 and the right side surface 106 oppose each other is the X axis direction. The direction in which the front surface 102 and the rear surface 109 oppose each other is the Y axis direction. The direction in which the upper surface 107 and the bottom surface 108 oppose each other is the Z axis direction. The X axis direction is the width direction of the printer 10, the Y axis direction is the depth direction of the printer 10, and the Z axis direction is the height direction of the printer 10.

The recording head 14 is configured to be able to move in a main scanning direction (X axis direction). The recording medium is conveyed in the Y axis direction inside of the housing 12 and ink is discharged from the recording head 14, whereby printing (recording) is performed on the recording medium. Note that in the present embodiment, the recording head 14 is configured to be able to move in the main scanning direction, but there is no limitation to this. For example, the recording head 14 may be a line head that extends in the X axis direction and has a fixed location.

The liquid container unit 30 is attached to the outer wall surface of the housing 12. In the present embodiment, the liquid container unit 30 is attached to the right side surface 106 of the housing 12. The liquid container unit (tank unit) 30 has a case 40 and multiple liquid containers 50K to 50Y, which are arranged inside of the case 40. Each of the multiple liquid containers 50K to 50Y is arranged inside of the case 40 such that a portion thereof (a later-described recognition surface 502) is visible from the outside. Accordingly, it is possible to find out the amount of ink (ink liquid surface) contained in the liquid containers 50K to 50Y from the outside of the case 40.

The liquid container 50K contains black ink. The liquid container 50C contains cyan ink. The liquid container 50M contains magenta ink. The liquid container 50Y contains yellow ink. The multiple liquid containers 50K to 50Y are arranged in alignment in the Y axis direction. The multiple liquid containers 50K to 50Y are in communication with the recording head 14 through flow pipes 99. The ink contained in the multiple liquid containers 50K to 50Y is supplied to the recording head 14 through the flow pipes 99 by a supply mechanism (not shown) such as a pump included in the printer 10.

Reference numeral 50 is used in the case where no distinction is made between the multiple liquid containers 50C to 50K. Note that there are four liquid containers 50, but there is no limitation to this. For example, there may be three or fewer liquid containers 50, or five or more liquid containers 50. Also, the liquid container unit 30 is attached to the right side surface 106 of the housing 12, but it may be attached to another surface (e.g., the left side surface 104) of the housing 12, or it may be provided inside of the housing 12.

Figure 2:
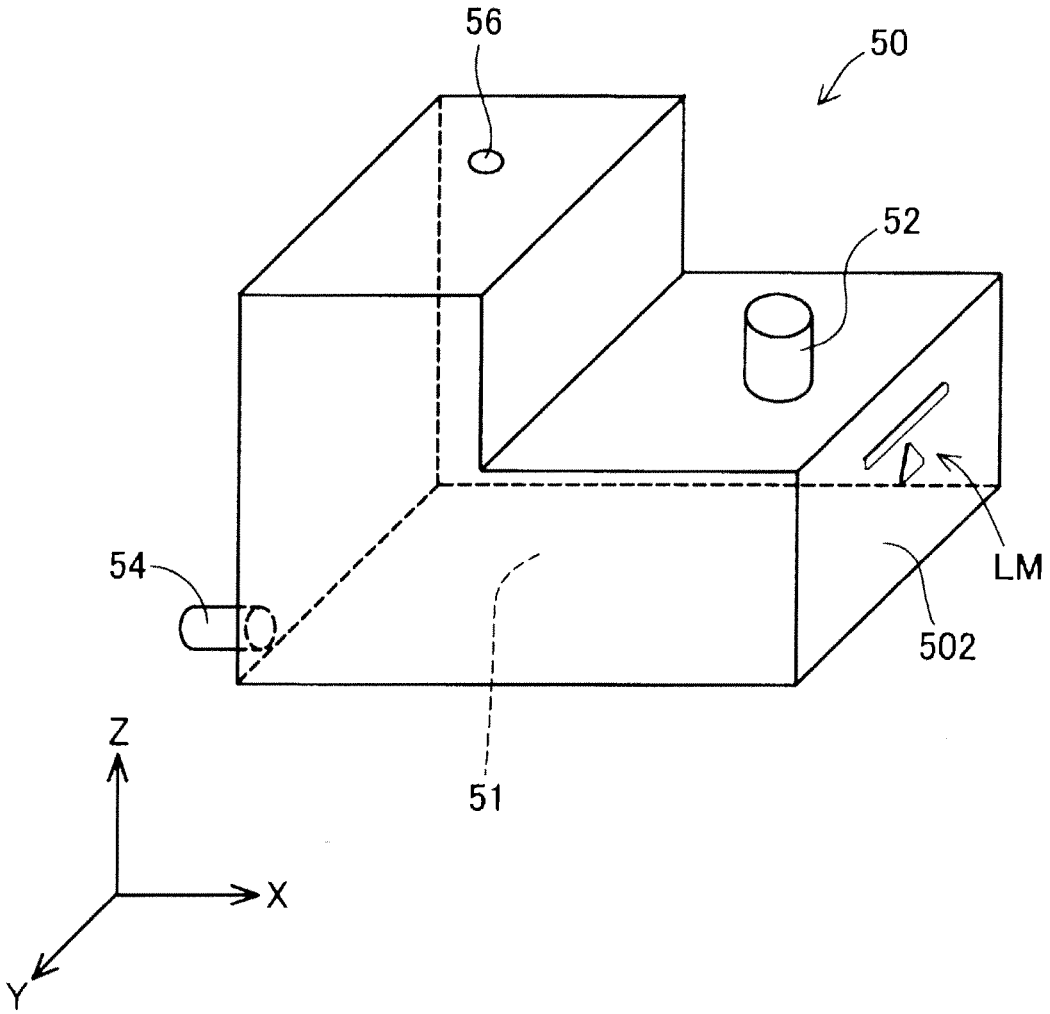
FIG. 2 is a schematic diagram of a liquid container.

FIG. 2 is a schematic diagram of the liquid container 50. The liquid container 50 includes a liquid containing portion 51 that can contain ink to be supplied to the printer 10, a liquid injection port (liquid receiving port, liquid replenishing port) 52 through which ink can be injected into the liquid containing portion 51, an air introduction port 56 for introducing air into the liquid containing portion 51, and a liquid outlet portion 54 for discharging the ink to the outside (in the present embodiment, to the printer 10).

The liquid injection port 52 is tube-shaped. The liquid injection port 52 is open in the vertical upward direction in a usage state of the liquid container unit 30 when ink is supplied from the liquid container 50 to the recording head 14, and in an injection state of the liquid container unit 30 when ink is injected into the liquid containing portion 51 through the liquid injection port 52. The liquid injection port 52 is closed by a plug member (not shown) in the usage state. The flow pipe 99 is connected to the liquid outlet portion 54. The ink in the liquid containing portion 51 flows through the liquid outlet portion 54 and the flow pipe 99 to the recording head 14. As the ink in the liquid containing portion 51 is consumed, the liquid surface of the liquid containing portion 51 lowers, and air is introduced into the liquid containing portion 51 through the air introduction port 56. If the amount of ink in the liquid containing portion 51 becomes small, the user removes the plug member from the liquid injection port 52 and injects ink into the liquid containing portion 51 through the liquid injection port 52.

In the usage state of the liquid container unit 30, the liquid container 50 includes a recognition surface 502 that is provided in a standing manner on the installation surface. The recognition surface 502 forms a portion of the liquid containing portion 51. The recognition surface 502 is a transparent or translucent member that makes it possible to recognize the ink surface of the liquid containing portion 51 from the outside. The recognition surface 502 is provided with an upper limit portion LM for recognizing the upper limit of ink that can be contained in the liquid containing portion 51. The upper limit portion LM includes a horizontal linear portion. Using the fact that the ink surface has reached the linear portion as a guide, the user stops the injection of ink into the liquid containing portion 51.

Figure 3:
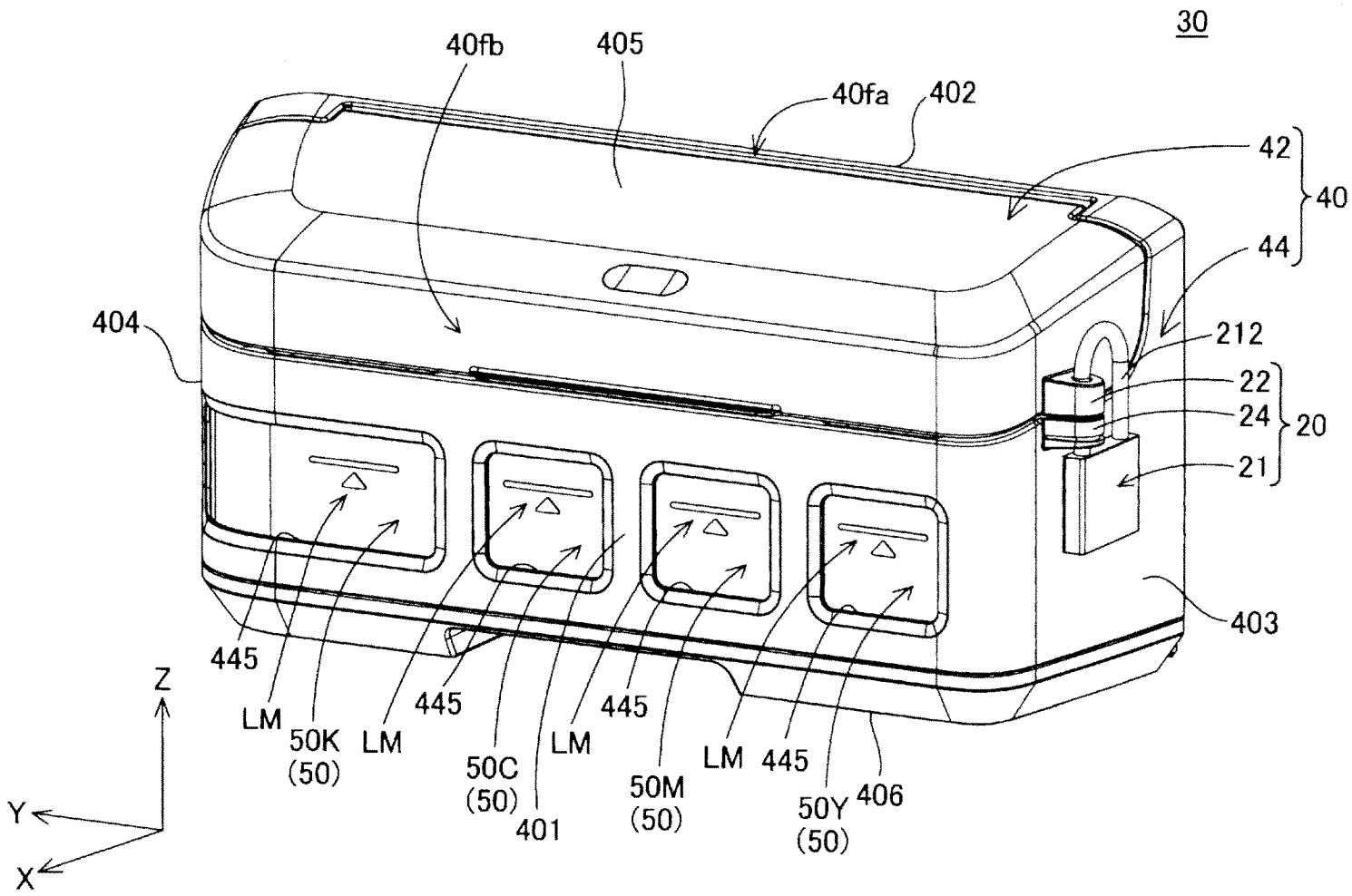
FIG. 3 is a first diagram for illustrating a liquid container unit.
Figure 4:
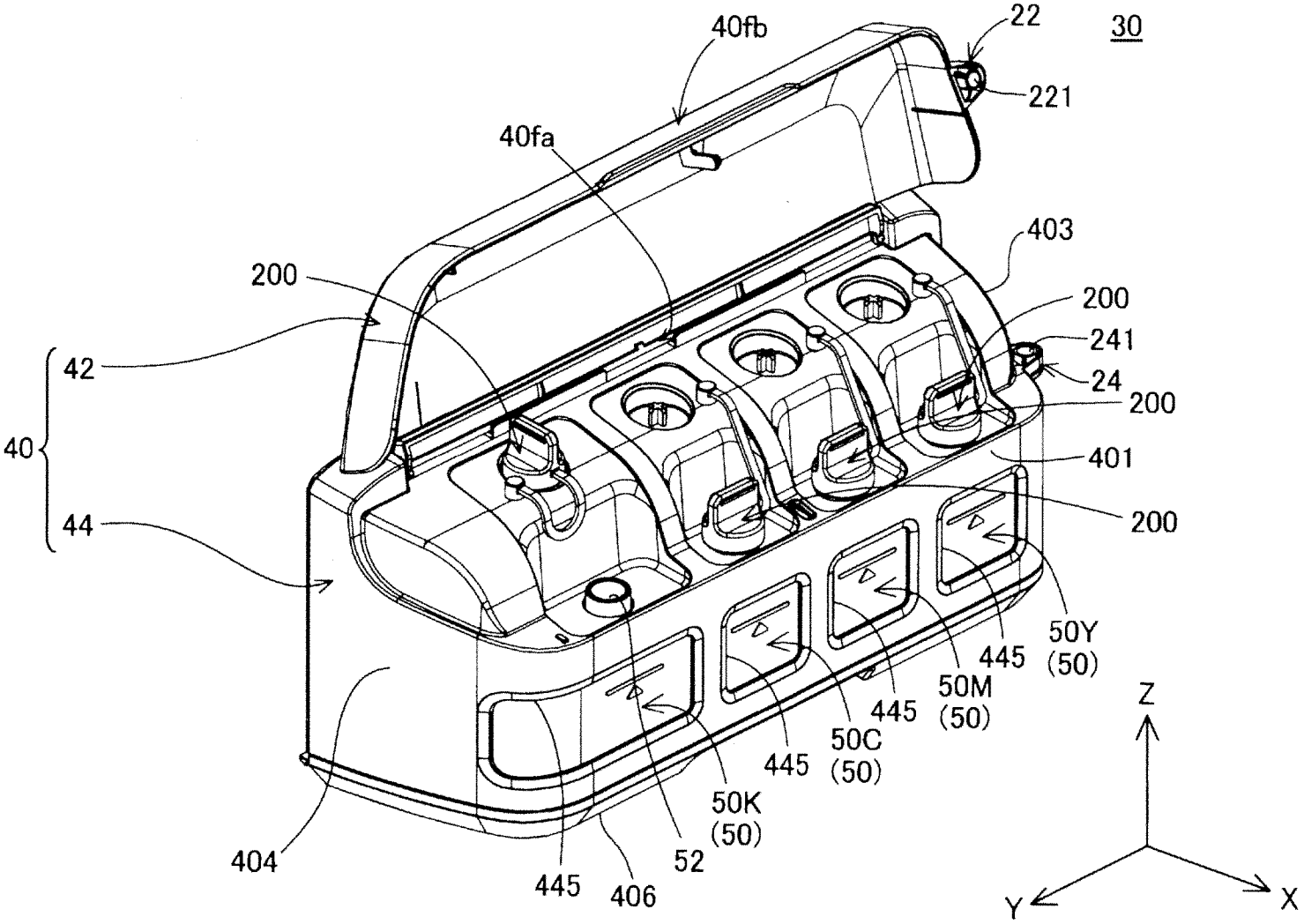
FIG. 4 is a second diagram for illustrating the liquid container unit.

FIG. 3 is a first diagram for illustrating the liquid container unit 30. FIG. 4 is a second diagram for illustrating the liquid container unit 30. FIG. 3 shows a first state, which is a state in which the case body 44 is closed. FIG. 4 shows a second state, which is a state in which the cover 42 is completely open. Also, in the liquid container 50K shown in FIG. 4, the plug member 200 has been removed from the liquid injection port 52.

The liquid container unit 30 (FIG. 3) includes a case 40 for containing the liquid containers 50. The case 40 is in the form of an approximate rectangular parallelepiped in the state in which the cover 42 is closed. Also, the case 40 covers the liquid containers 50 in the state in which the cover 42 is closed. The case 40 has a first surface 401 to a sixth surface 406, which constitute an outer shell. The first surface (case first wall) 401 and the second surface (case second wall) 402 oppose each other. The third surface (case third wall) 403 and the fourth surface (case fourth wall) 404 oppose each other. In the state in which the cover 42 is closed, the fifth surface (case fifth wall) 405 and the sixth surface (case sixth wall) 406 oppose each other. In the present embodiment, the first surface 401 and the second surface 402 oppose each other in the X axis direction, the third surface 403 and the fourth surface 404 oppose each other in the Y axis direction, and the fifth surface 405 and the sixth surface 406 oppose each other in the Z axis direction. The first surface 401 to the fourth surface 404 are surfaces that are approximately perpendicular to the installation surface. The fifth surface 405 constitutes the upper surface of the case 40, and the sixth surface 406 constitutes the bottom surface of the case 40. The X axis direction is the depth direction of the case 40, the Y axis direction is the width direction of the case 40, and the Z axis direction is the height direction of the case 40.

The first surface 401 includes visual checking portions 445 that are configured such that the upper limit portions LM are visible from the outside. That is to say, the visual checking portions 445 make it possible to check the liquid surfaces in the liquid containing portions 51 via the recognition surfaces 502. The visual checking portions 445 are openings formed in the first surface 401. Note that in another embodiment, the visual checking portions 445 may be such that portions that are open are formed with transparent members or translucent members instead of openings. The second surface 402 is attached to the housing 12 (FIG. 1) with an attachment member such as a screw. Openings (not shown) are formed in the second surface 402 in order to arrange the flow pipes 99 (FIG. 1).

The case 40 includes a case body 44 that contains the liquid containers 50, and the cover 42, which is attached openably/closeably to the case body 44. As shown in FIG. 4, the case body 44 contains the liquid containers 50 such that portions (upper ends) of the liquid injection ports 52 are located on the outside. The case body 44 forms mainly the first surface 401 to the fourth surface 404, and the sixth surface 406. Note that the case body 44 may contain the liquid containers 50 such that portions (upper ends) of the liquid injection ports 52 are visible from the outside in a state where caps 200 are removed, without the portions (upper ends) of the liquid injection ports 52 being located on the outside.

The cover 42 (FIG. 3) forms mainly the fifth surface 405, which is the upper surface. The cover 42 has a rotation mechanism (to be described in detail later) that is provided on an axis-side end 40*fa*, which is the end toward the second surface 402 of the cover 42, and engages with the case body 44. The rotation axis direction of the rotation mechanism is the direction parallel to the Y axis direction. The cover 42 opens and closes due to a free end 40*fb*, which is the end toward the first surface 401 of the cover 42, rotating centered about the rotation axis of the rotation mechanism. The cover 42 covers the liquid injection port 52 in the closed state. As shown in FIG. 4, in the open state of the cover 42, the liquid injection port 52 in which the plug member 200 is mounted is exposed. When the cover 42 is in the open state, the user removes the plug member 200 from the liquid injection port 52 and injects ink into the liquid containing portion 51.

The liquid container unit 30 (FIG. 3) includes a locking mechanism 20 according to which the closed state can be held by locking. The locking mechanism 20 includes a padlock 21 serving as a lock, and a first insertion portion 22 and a second insertion portion 24, to which the padlock 21 is attached.

The first insertion portion 22 (FIG. 4) includes a first through hole 221 through which a lock arm 212 of the padlock 21 is inserted. The second insertion portion 24 includes a second through hole 241 through which the lock arm 212 of the padlock 21 is inserted. The first insertion portion 22 is provided on a portion of the cover 42 forming the third surface 403. The second insertion portion 24 is provided on a portion of the case body 44 forming the third surface 403. The state in which the cover 42 is closed is held by the padlock 21 being locked using a key in a state in which the lock arm 212 is inserted into the first through hole 221 and the second through hole 241. The "state in which the cover 42 is closed" includes a state of being completely closed, as well as a state in which a gap of such an extent that a task of injecting ink into the liquid container 50 cannot be performed exists between the case body 44 and the cover 42.

Figure 5:
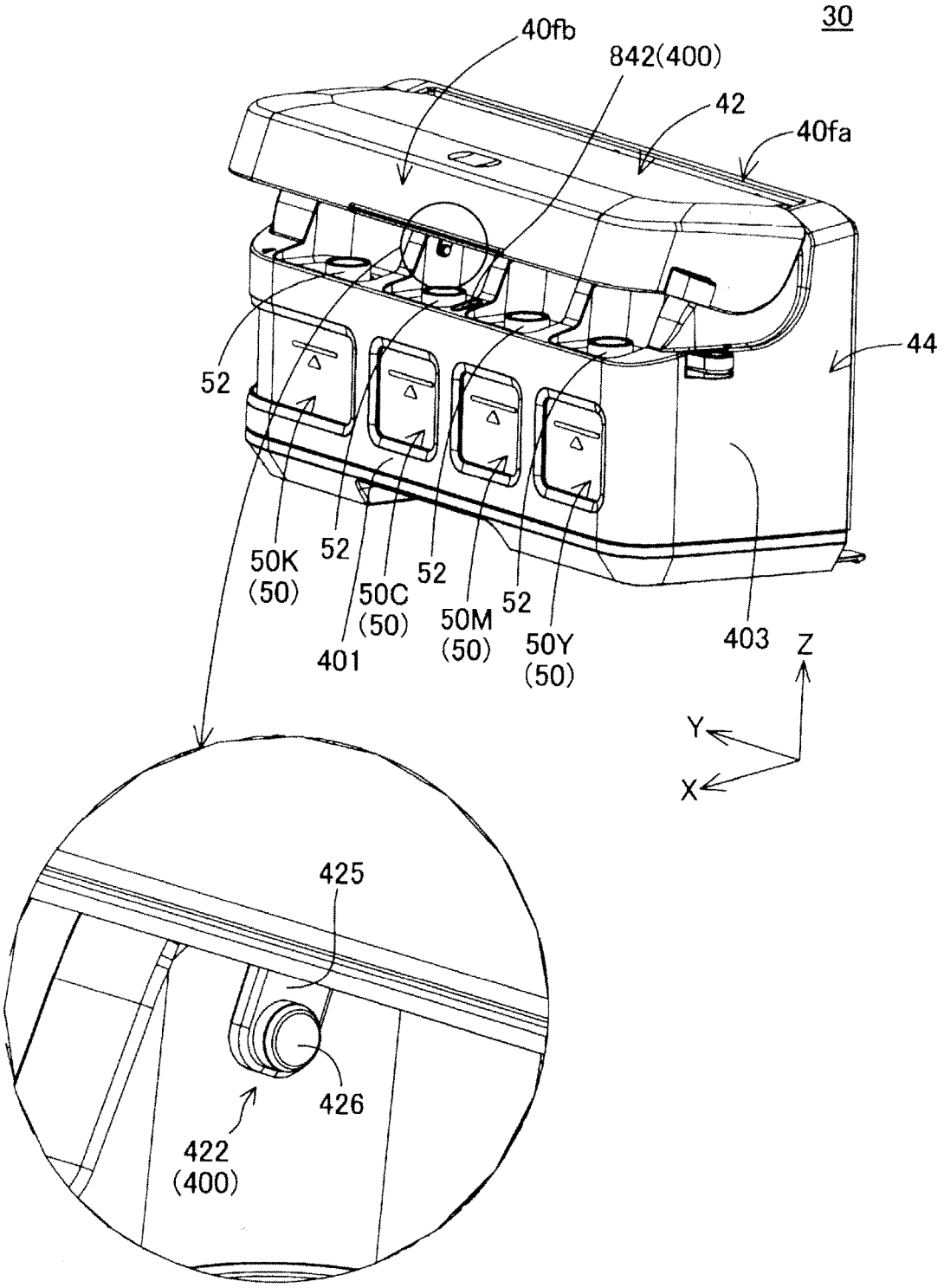
FIG. 5 is a diagram for illustrating an attachment mechanism.

FIG. 5 is a diagram for illustrating an attachment mechanism 400. The liquid container unit 30 further includes the attachment mechanism 400. The attachment mechanism 400 detachably attaches the free end 40*fb*, which is located on a side opposite to the side on which the axis-side end 40*fa* (side on which a later-described rotation mechanism is located) is located, to the case body 44. In the present embodiment, the attachment mechanism 400 employs snap-fitting, which is a method of fixing using the elasticity of a material.

The attachment mechanism 400 includes a case body-side attachment portion 842 provided on the case body 44, and a cover-side attachment portion 422 provided on the free end 40*fb* of the cover 42. The case body-side attachment portion 842 is a recessed portion provided on the upper surface of the case body 44. The cover-side attachment portion 422 is a protruding portion that is fastened by being fit into the case body-side attachment portion 842, which is a recessed portion. The cover-side attachment portion 422 is elastic to such a degree that it is capable of being fastened to and unfastened from the case body-side attachment portion 422. The cover-side attachment portion 422 is provided at a location that is approximately in the center in the Y axis direction of the cover 42. The cover-side attachment portion 422 includes a plate-shaped body portion 425 attached to the cover 42, and a protrusion 426 provided on the body portion 425. In the state in which the cover 42 is closed, the protrusion 426 is fastened to the case body-side attachment portion 842. Accordingly, the free end 40*fb* is detachably attached to the case body 44. When the padlock 21 is unlocked, the user unfastens the cover-side attachment portion 422 and the case body-side attachment portion 842 by lifting up the free end 40*fb* side of the cover 42 in the vertical upward direction.

Figure 6:
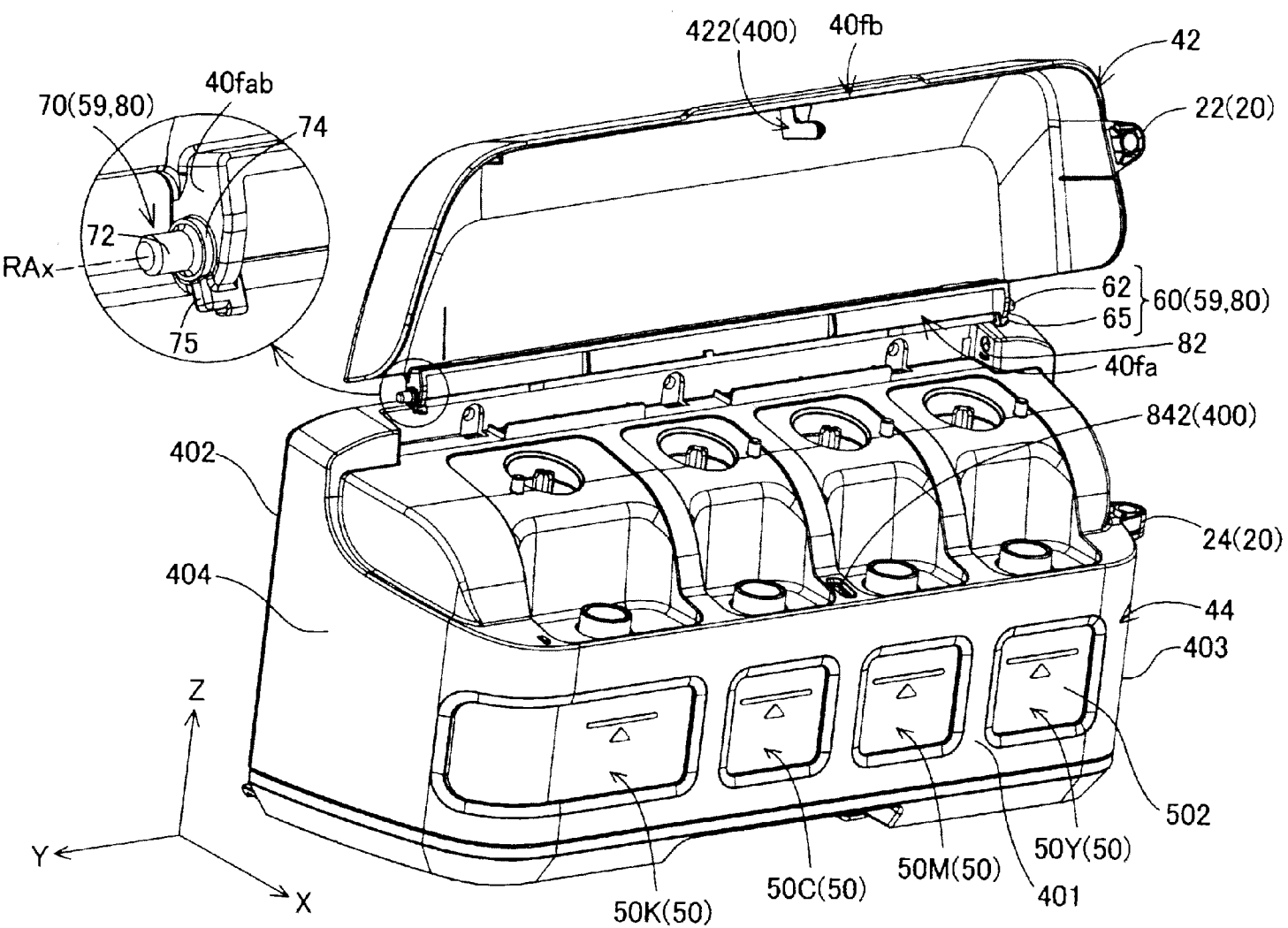
FIG. 6 is a first diagram in which a cover is removed from a case body.
Figure 7:
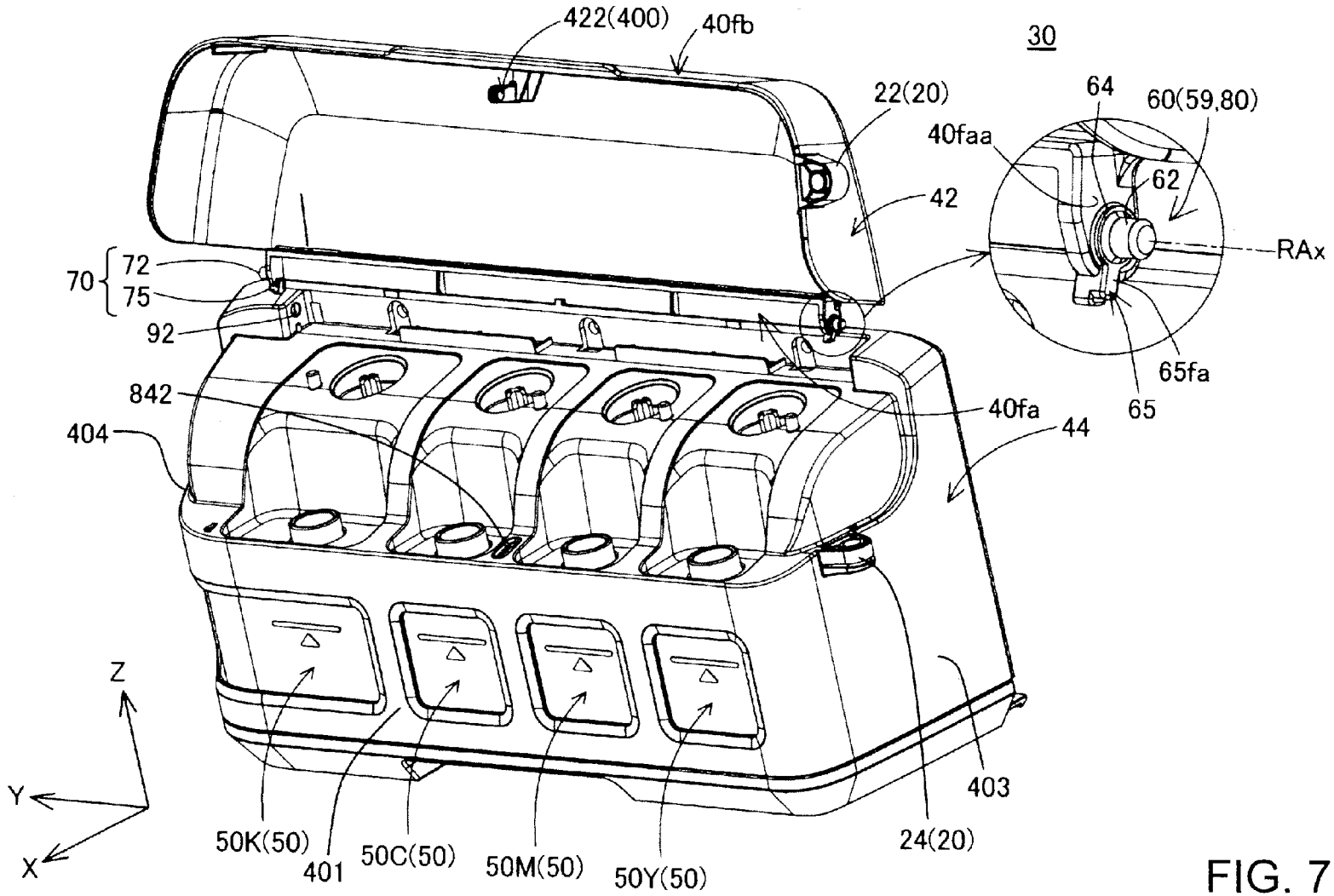
FIG. 7 is a second diagram in which the cover is removed from the case body.
Figure 8:
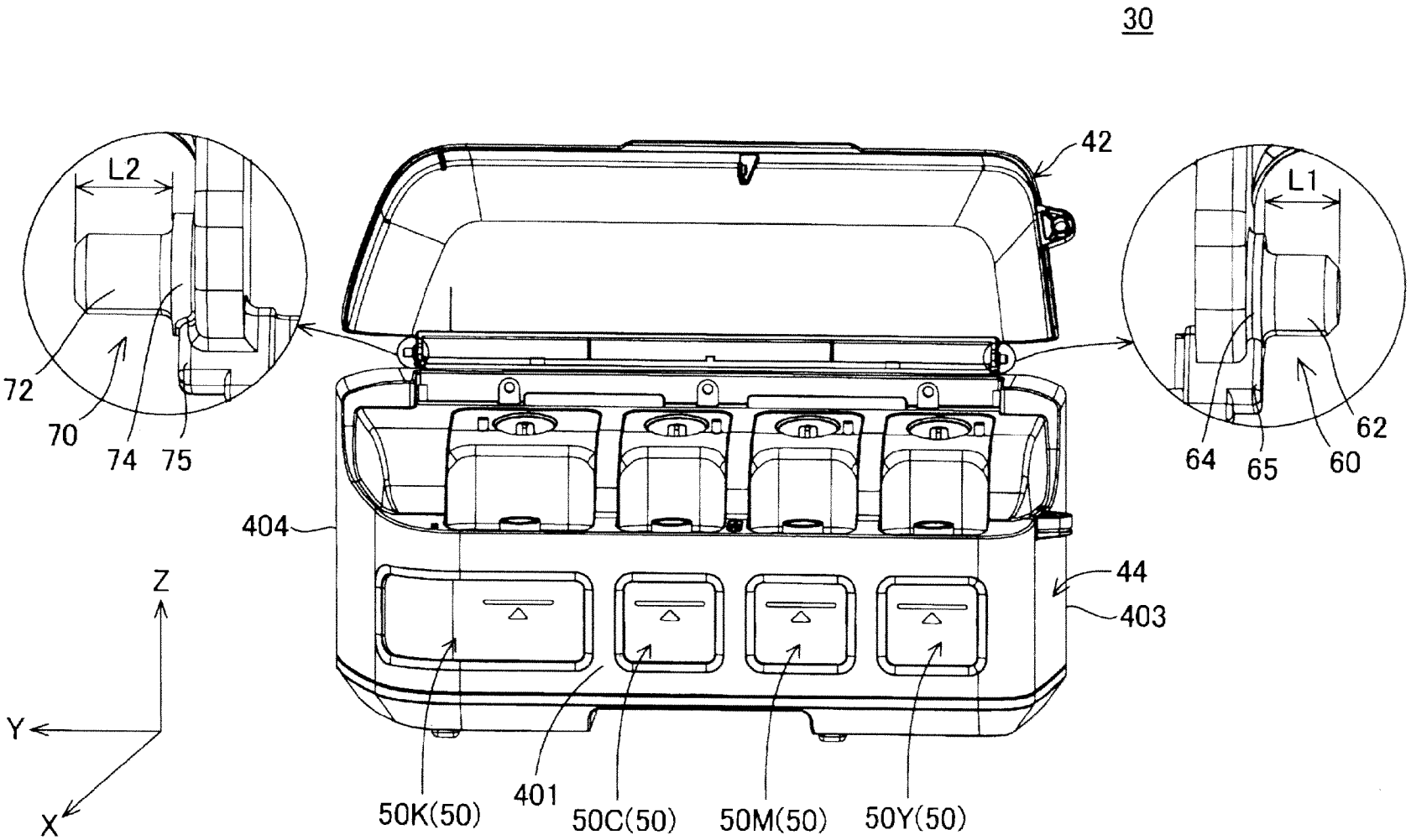
FIG. 8 is a third diagram in which the cover is removed from the case body.
Figure 9:
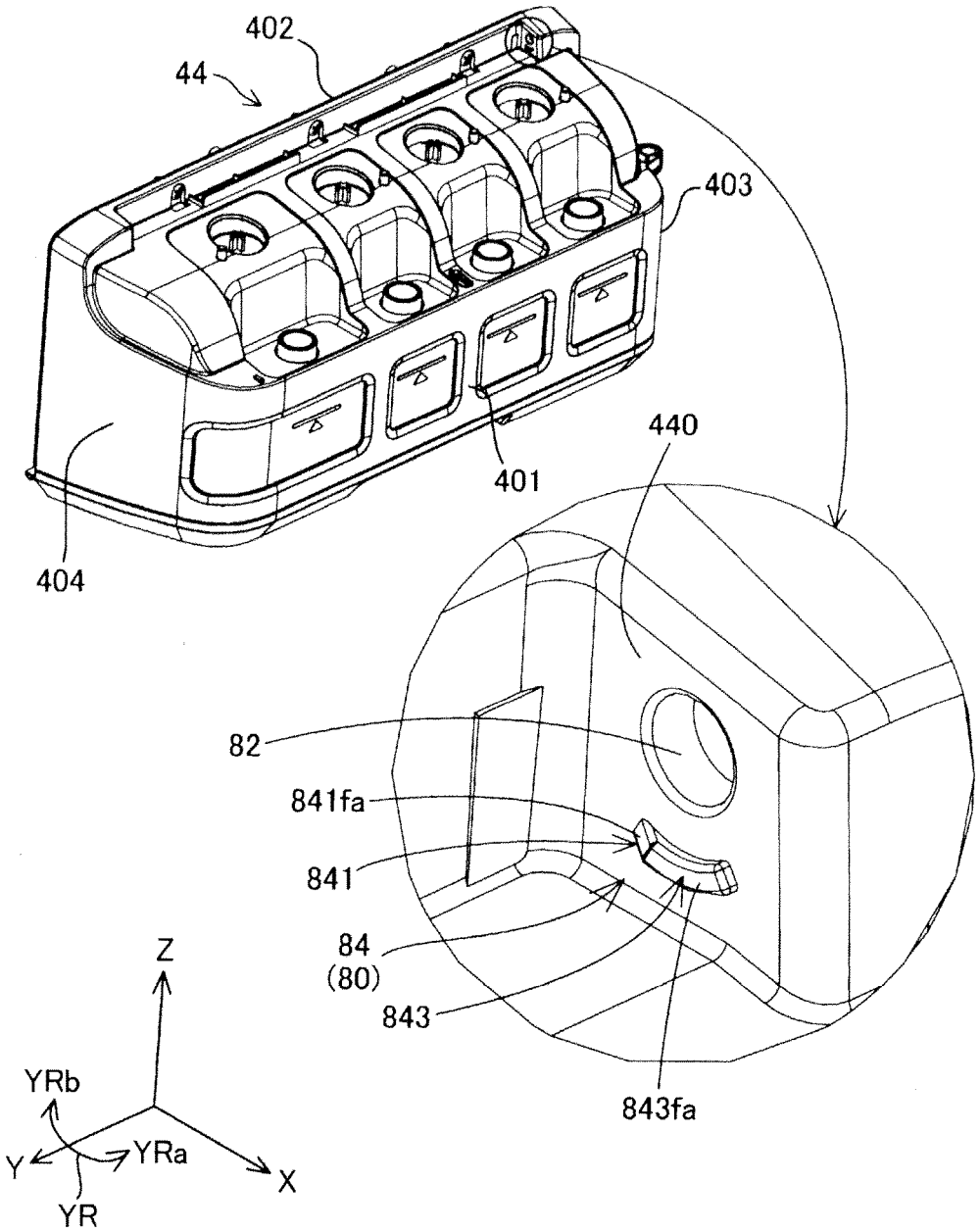
FIG. 9 is a first diagram for illustrating the case body.
Figure 10:
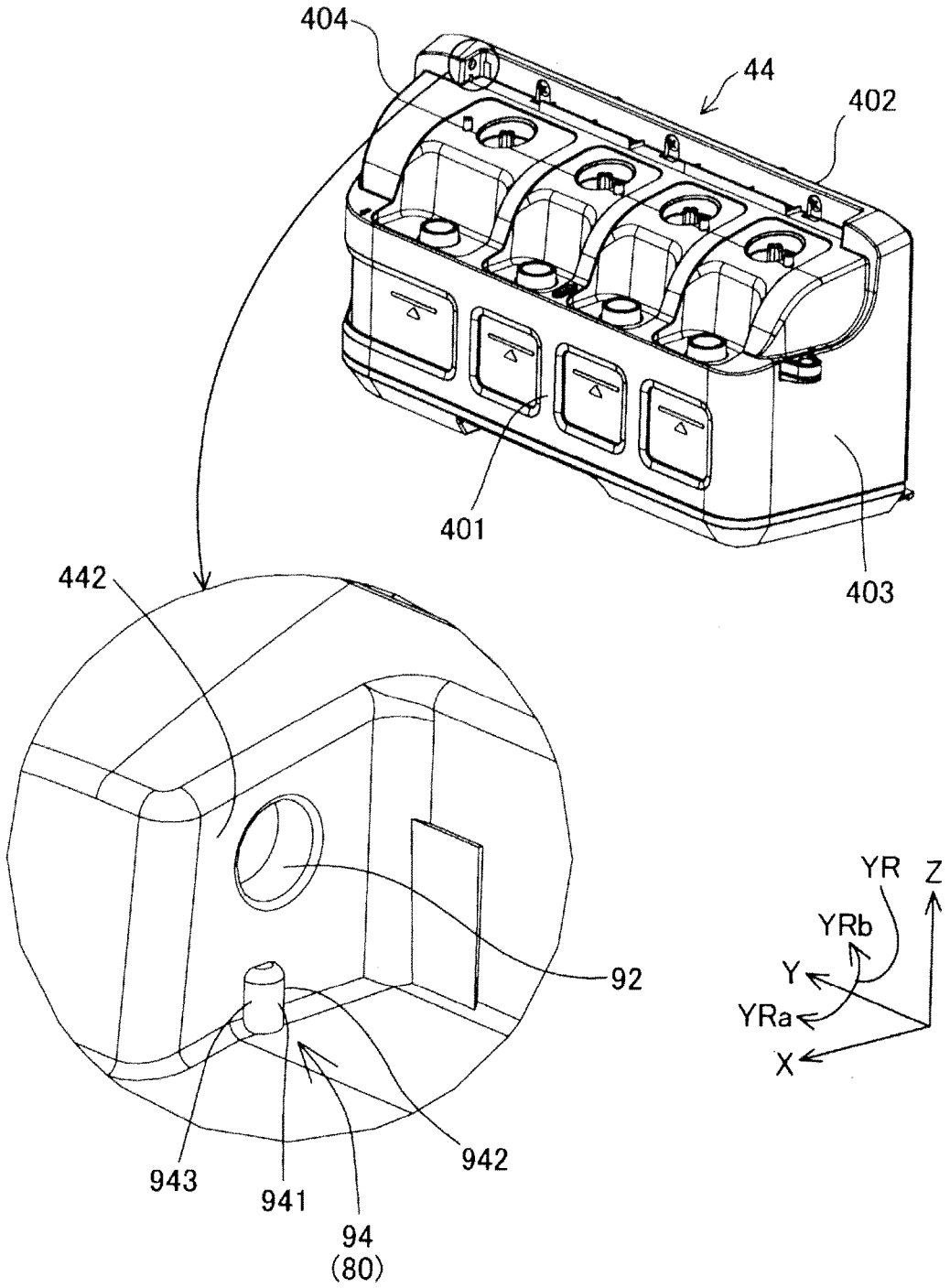
FIG. 10 is a second diagram for illustrating the case body.

FIG. 6 is a first drawing in which the cover 42 is removed from the case body 44. FIG. 7 is a second drawing in which the cover 42 is removed from the case body 44. FIG. 8 is a third drawing in which the cover 42 is removed from the case body 44. FIG. 9 is a first diagram for illustrating the case body 44. FIG. 10 is a second diagram for illustrating the case body 44.

The cover 42 (FIGS. 6 and 7) includes a rotation mechanism 59 that forms a rotation axis RAx for opening and closing the cover 42. The rotation mechanism 59 includes a shaft that forms a rotational center. The rotation mechanism 59 is rotatably engaged with the case body 44. The cover 42 is attached to the case body 44 due to the engagement between the rotation mechanism 59 and the case body 44. The rotation mechanism 59 includes a first rotation shaft 60 (FIG. 7) serving as a first rotation portion, and a second rotation shaft 70 (FIG. 6) serving as a second rotation portion.

The first rotation shaft 60 (FIG. 7) is provided on an end 40*faa* of the axis-side end 40*fa* toward the side on which the locking mechanism 20 is located in the Y axis direction (alignment direction of the multiple liquid containers 50K to 50Y, rotation axis direction). The first rotation shaft 60 includes a first shaft body 62, a first base portion 64, and a first contact portion 65. The first base portion 64 is attached to the end 40*faa* of the cover 42. The first base portion 64 opposes a first shaft hole forming surface 440 (FIG. 9) in which a first shaft hole 82 is formed. The first base portion 64 is disc-shaped. The first contact portion 65 is a member that projects outward in a radial direction from the circumferential surface of the first base portion 64. The first contact portion 65 has an opposing surface 65*fa* that opposes a later-described displacement portion 84 (FIG. 9) in the Y axis direction (rotation axis direction). The first shaft body 62 is an approximately cylindrical member that projects from the first base portion 64 in a direction of moving away from the end portion 40*faa* (−Y axis direction). The first shaft body 62 has a smaller radius than the first base portion 64. The first shaft body 62 engages with the first shaft hole 82 by being inserted into the first shaft hole 82 (FIG. 6), which is included in the case body 44.

The second rotation shaft 70 (FIG. 6) is provided on an end 40*fab* of the axis-side end 40*fa* on the side opposite to the side on which the first rotation shaft 60 is located in the Y axis direction. The second rotation shaft 70 includes a second shaft body 72, a second base portion 74, and a second contact portion 75 serving as the cover-side fastening portion. The second base portion 74 is attached to the end 40*fab* of the cover 42. The second base portion 74 opposes a second shaft hole forming surface 442 (FIG. 10) in which a second shaft hole 92 is formed. The second base portion 74 is disc-shaped. The second contact portion 75 is a member that projects outward in a radial direction from the circumferential surface of the second base portion 74. The second shaft body 72 is an approximately cylindrical member that projects from the second base portion 74 toward a direction of moving away from the end portion 40*fab* (+Y axis direction). The second shaft body 72 has a smaller radius than the second base portion 74. The second shaft body 72 engages with the second shaft hole 92 by being inserted into the second shaft hole 92 (FIG. 7), which is included in the case body 44. That is to say, the second rotation shaft 70 engages with the case body 44 at a location that is farther away from the locking mechanism 20 than the first rotation shaft 60 is in the rotation axis direction (Y axis direction) of the rotation mechanism 59.

As shown in FIG. 8, a shaft length (second length) L2 of the second shaft body 72 is longer than a shaft length (first length) L1 of the first shaft body 62 in the rotation axis direction (Y axis direction) of the rotation mechanism 59. The shaft length L1 is the length of the engaging portion at which the case body 44 (specifically, the first shaft hole 82 shown in FIG. 6) and the first rotation shaft 60 are engaged, and the shaft length L2 is the length of the engaging portion at which the case body 44 (specifically, the second shaft hole 92 shown in FIG. 7) and the second rotation shaft 70 are engaged.

The case 40 further includes an open state holding mechanism 80 (FIGS. 6, 7, 9, and 10) capable of holding the state in which the cover 42 is open. The open state holding mechanism 80 can hold the cover 42 in the open state to such a degree that the cover 42 does not rotate from the open state (FIG. 4) to the closed state (FIG. 3) due to the weight of the cover 42. The open state holding mechanism 80 includes the first rotation shaft 60 (FIG. 7), the second rotation shaft 70 (FIG. 6), the displacement portion 84 (FIG. 9), and the case body-side fastening portion 94 (FIG. 10).

The case body-side fastening portion 94 (FIG. 10) is provided on the second shaft hole forming surface 442 in which the second shaft hole 92 is formed. The case body-side fastening portion 94 is formed below the second shaft hole 92. The second shaft hole forming surface 442 is located on the second surface 402 side and the vertical upward direction side of the case body 44. With respect to the Y axis direction (rotation axis direction), the second shaft hole forming surface 442 is located on the +Y axis direction side with respect to the attachment mechanism 400 (FIG. 5). The second shaft hole forming surface 442 is provided in a standing manner on a horizontal surface in the usage state of the liquid container unit 30.

The case body-side fastening portion 94 (FIG. 10) is configured to be able to hold the state in which the case body 44 is open by the second contact portion 75 (FIG. 6), which serves as the cover-side fastening portion, being engaged therewith. The case body-side fastening portion 94 is a protruding member that protrudes from the second shaft hole forming surface 442. The surface of the case body-side fastening portion 94 forms a protruding curved surface. Here, the direction along the direction in which the rotation mechanism 59 rotates is a rotation direction YR. In the rotation direction YR, the direction in which the rotation mechanism 59 rotates from the state in which the cover 42 is closed to the state in which the cover 42 is open is opening direction YRa. In the rotation direction YR, the direction in which the rotation mechanism 59 rotates from the state in which the cover 42 is open to the state in which the cover 42 is closed is closing direction YRb. The opening direction YRa is a direction that is clockwise in a view from a −Y axis direction side.

The case body-side fastening portion 94 includes a peak portion 941, and a first portion 942 and second portion 943 that are arranged so as to sandwich the peak portion 941 in the rotation direction YR. In the opening direction YRa, the first portion 942 is arranged on the near side with respect to the second portion 943. The peak portion 941 is arranged at a location that is higher than the first and second portions 942 and 943 with respect to the second shaft hole forming surface 442.

The displacement portion 84 (FIG. 9) is provided on the first shaft hole forming surface 440 in which the first shaft hole 82 is formed. The displacement portion 84 is formed below the first shaft hole 82. The first shaft hole forming surface 440 is located on the second surface 402 side and the vertical upward direction side of the case body 44. The first shaft hole forming surface 442 is located on the −Y axis direction side with respect to the attachment mechanism 400 (FIG. 5) in the Y axis direction (rotation axis direction). The second shaft hole forming surface 442 is provided in a standing manner on a horizontal surface in the usage state of the liquid container unit 30. The first shaft hole forming surface 442 and the second shaft hole forming surface 442 oppose each other in the Y axis direction (rotation axis direction).

When the rotation mechanism 59 rotates from the state in which the cover 42 is closed to the state in which the cover 42 is open, the displacement portion 84 displaces the rotation mechanism 59 in the Y axis direction (rotation axis direction) from the first rotation shaft 60 to the second rotation shaft 70. This displacement will be described in detail later. The displacement portion 84 has a protruding shape that protrudes from the first shaft hole forming surface 440. The displacement portion 84 extends in the rotation direction YR. The displacement portion 84 is located on the displacement (rotation) path of the first contact portion 65 (FIG. 7). The displacement portion 84 includes a first protruding portion 841 and a second protruding portion 843. With respect to the opening direction YRa, the first protruding portion 841 is located on the near side, and the second protruding portion 843 is located on the far side with respect to the first protruding portion 841. The first protruding portion 841 and the second protruding portion 843 are connected. The height of the first protruding portion 841 from the first shaft hole forming surface 440 increases gradually from the near side to the far side in the opening direction YRa. That is, a first surface 841*fa* of the first protruding portion 841 that opposes the first contact portion 65 (FIG. 7) in the Y axis direction (rotation axis direction) is inclined such that the height thereof from the first shaft hole forming surface 440 increases steadily from the near side to the far side. A second surface 843*fa* of the second protruding portion 843 that opposes the first contact portion 65 in the Y axis direction (rotation axis direction) has the same height as the far-side portion of the first surface 841*fa*.

Figure 11:
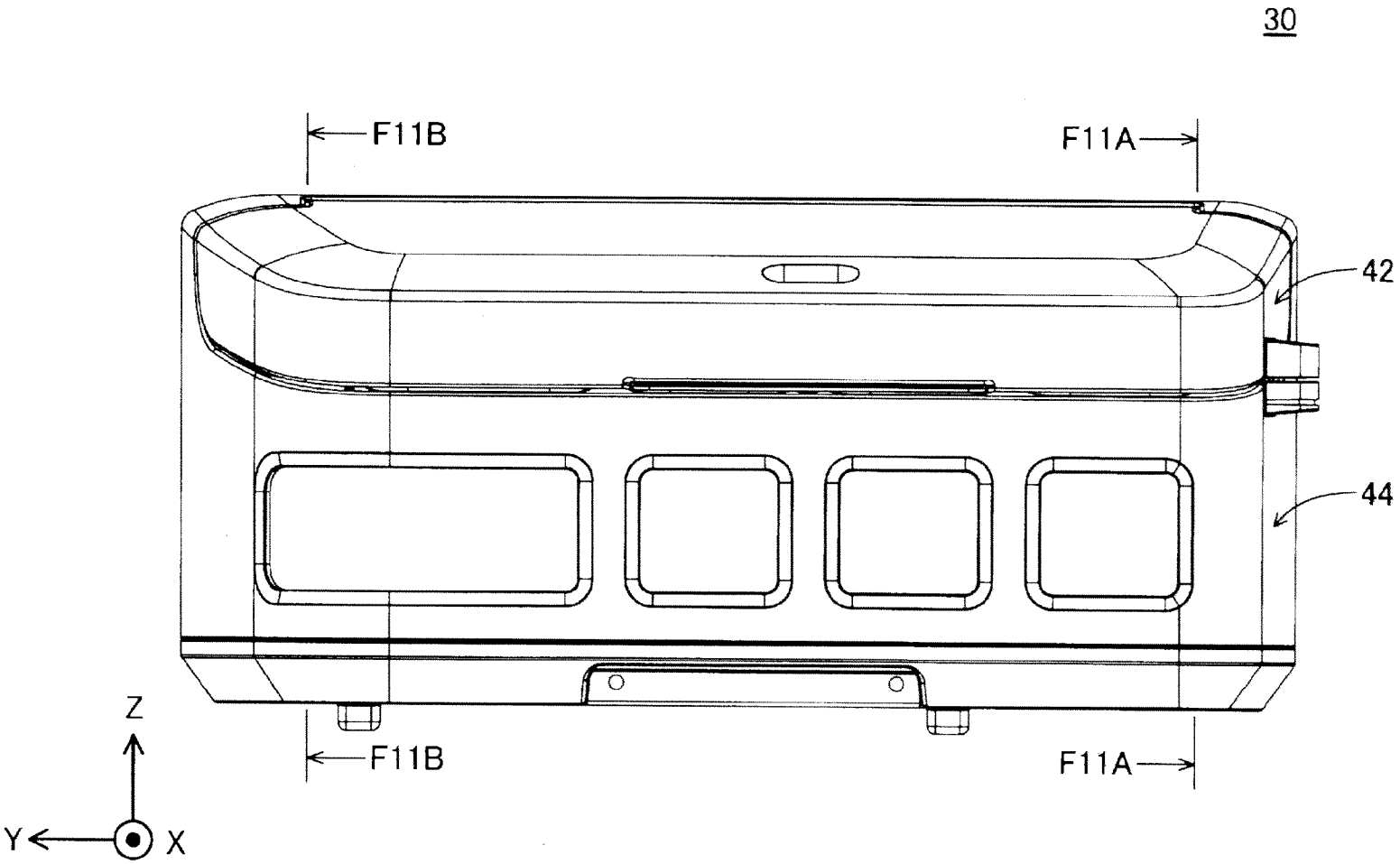
FIG. 11 is a diagram showing a state in which the cover is closed.
Figure 12:
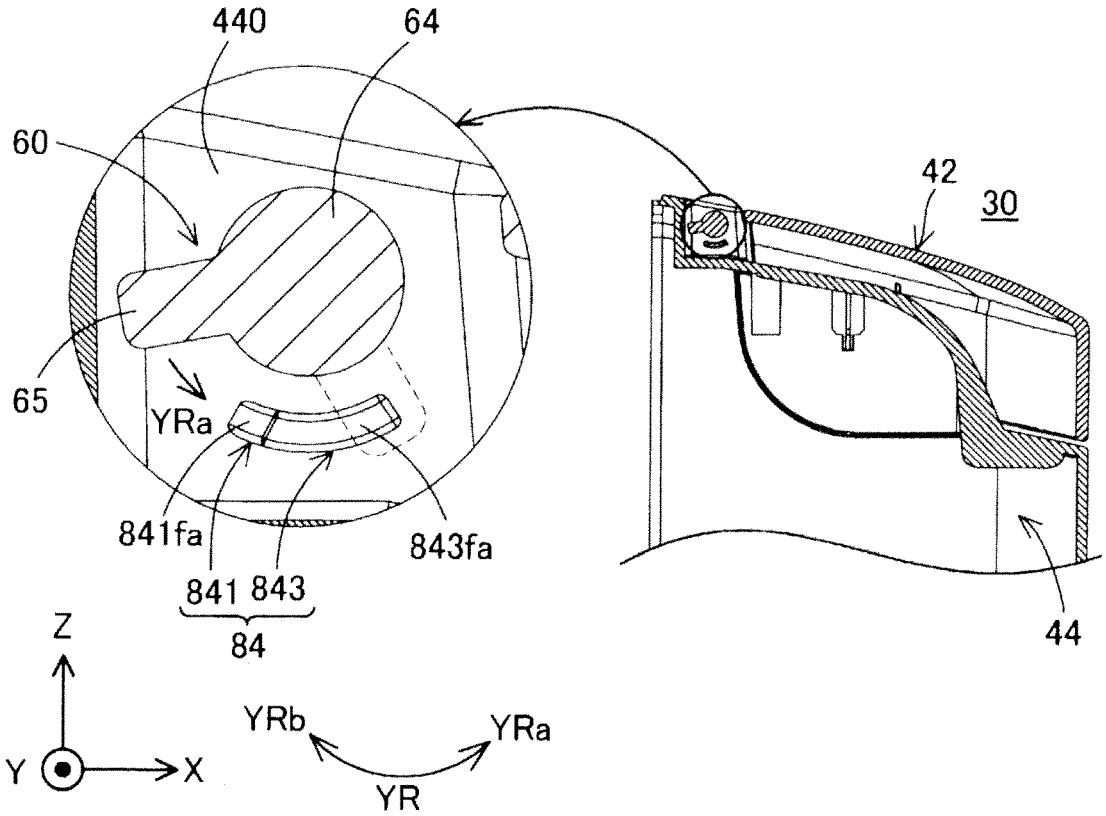
FIG. 12 is a partial cross-sectional view taken along line F11A-F11A.
Figure 13:
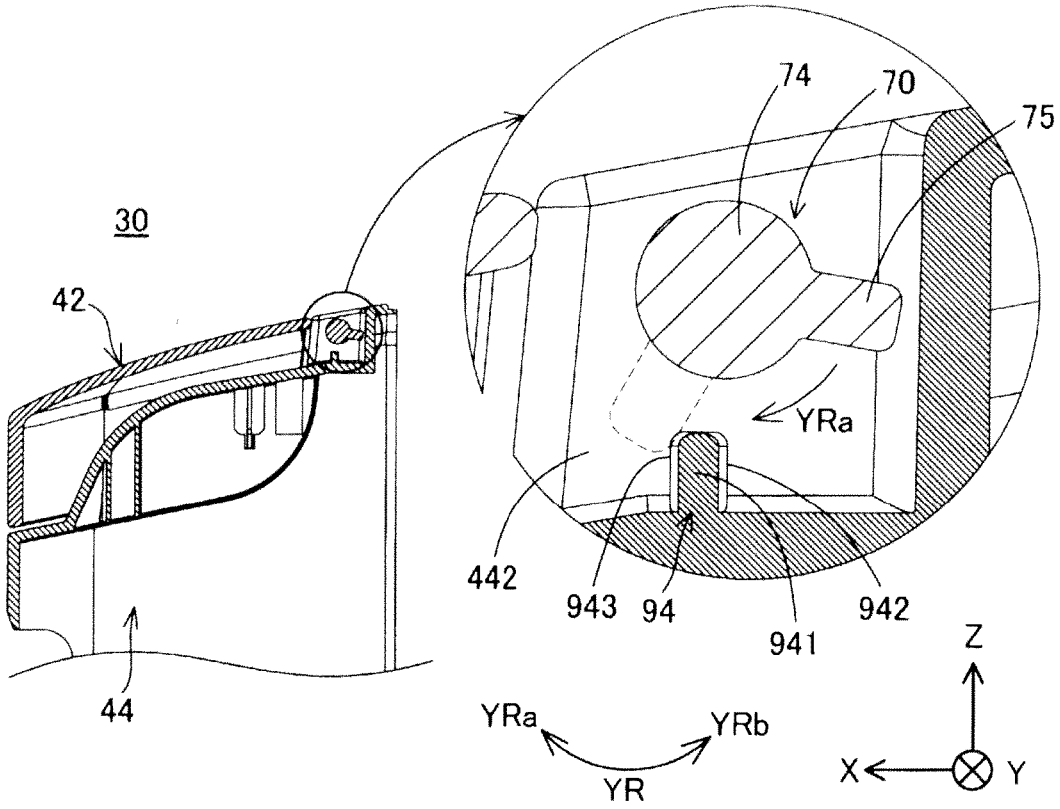
FIG. 13 is a partial cross-sectional view taken along line F11B-F11B.
Figure 14:
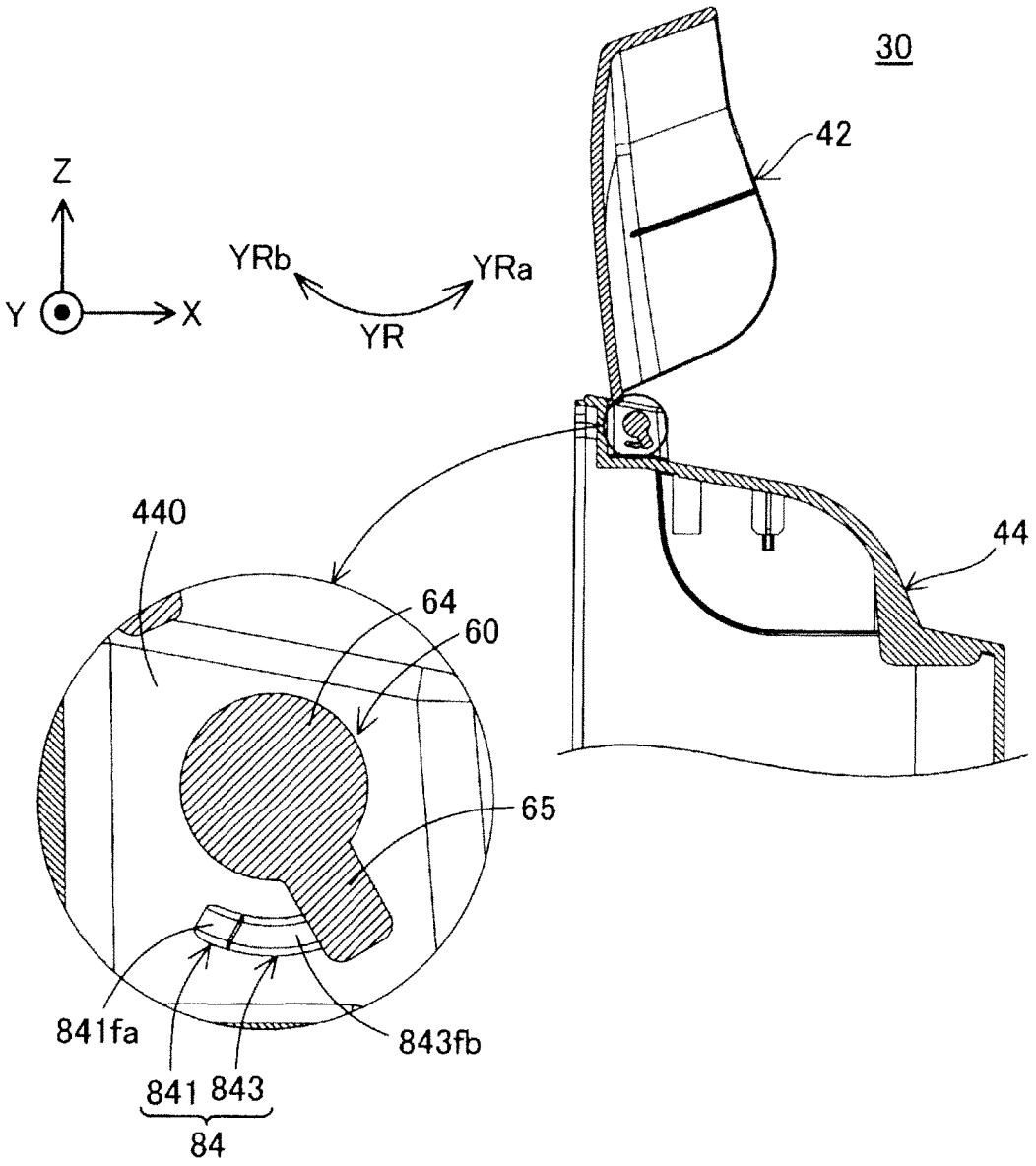
FIG. 14 is a diagram corresponding to the partial cross-sectional view taken along line F11A-F11A.
Figure 15:
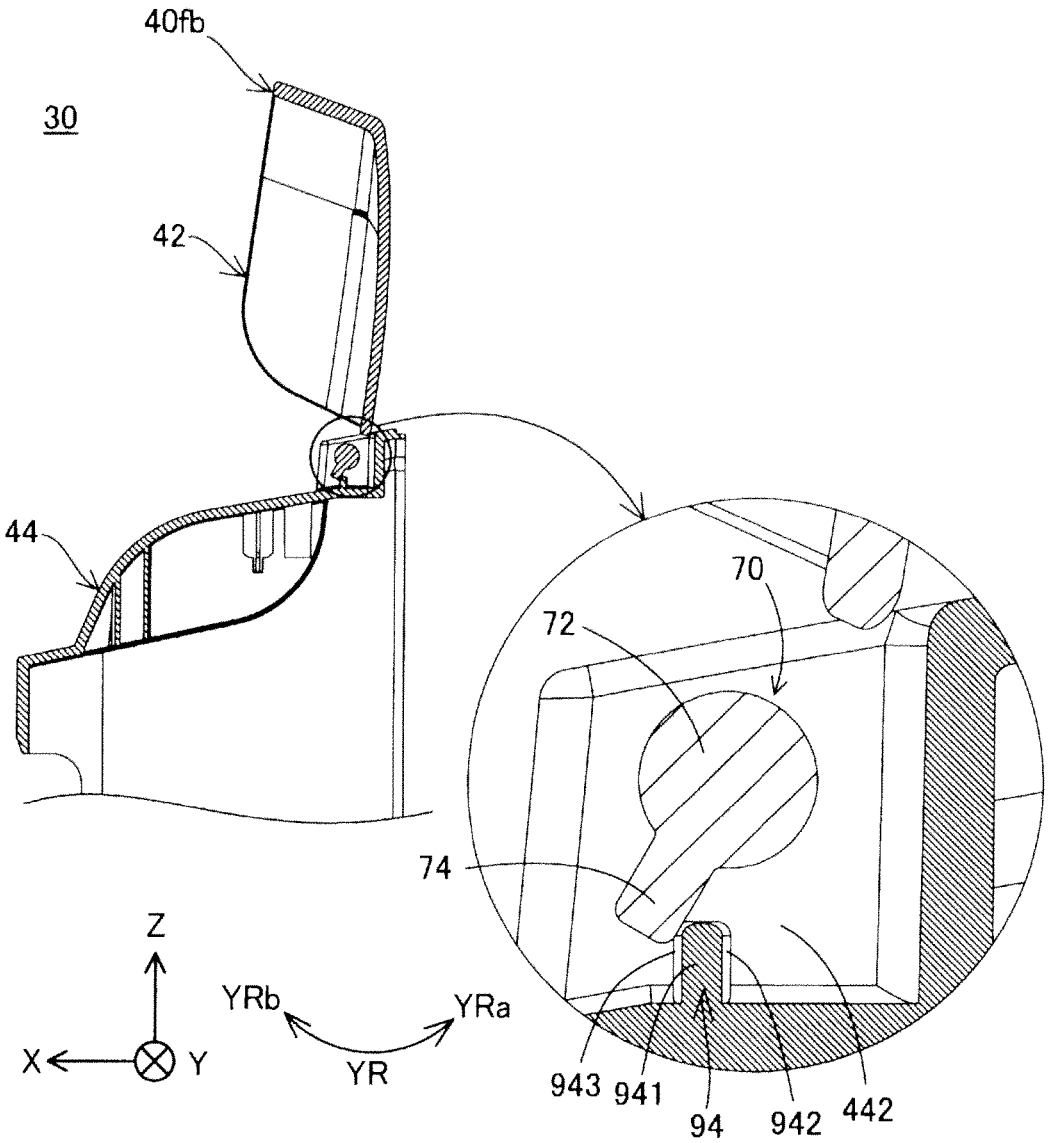
FIG. 15 is a diagram corresponding to the partial cross-sectional view taken along line F11B-F11B.

FIG. 11 is a diagram showing a state in which the cover 42 is closed. FIG. 12 is a partial cross-sectional view taken along line F11A-F11A. FIG. 13 is a partial cross-sectional view taken along line F11B-F11B. FIG. 14 is a diagram corresponding to the partial cross-sectional view taken along line F11A-F11A in the state in which the cover 42 is open. FIG. 15 is a diagram corresponding to the partial cross-sectional view taken along line F11B-F11B in the state in which the cover 42 is open. The open state holding mechanism 80 will be described in detail with reference to FIGS. 11 to 15.

As shown in FIG. 12, in the state in which the cover 42 is closed, the first contact portion 65 is located on the closing direction YRb side in the rotation direction YR with respect to the displacement portion 84. If the cover 42 is opened, the first rotation shaft 60 rotates in the opening direction YRa, and in the state in which the cover 42 is open, the first contact portion 65 reaches the position indicated by the broken line. Specifically, if the state is changed from the state in which the cover 42 is closed to the state in which the cover 42 is open, the first contact portion 65 moves along the opening direction YRa and onto the first protruding portion 841 (specifically, the first surface 841*fa*). Then, after moving past the first protruding portion 841, the first contact portion 65 moves onto the second protruding portion 843 (specifically, the second surface 843*fa*) (FIG. 14).

As shown in FIG. 13, in the state in which the case is closed, the second contact portion 75 is located on the closing direction YRb side in the rotation direction YR with respect to the case body-side fastening portion 94. If the cover 42 is opened, the second rotation shaft 70 rotates in the opening direction YRa, and in the state in which the cover 42 is open, the second contact portion 75 reaches the position indicated by the broken line.

Due to the first contact portion 65 moving onto the displacement portion 84, the rotation mechanism 59, which includes the first rotation shaft 60 and the second rotation shaft 70, is displaced from the first rotation shaft 60 side to the second rotation shaft 70 side (direction of approaching the case body-side fastening portion 94, +Y axis direction side). Due to this displacement, the second contact portion 75 serving as the cover-side fastening portion is pressed to the case body-side fastening portion 94. When the first contact portion 65 reaches the second protruding portion 843 via the first protruding portion 841, the second contact portion 75 is located on the first portion 942 side. Due to the first contact portion 65 moving further in the opening direction YRa on the second protruding portion 843, the second contact portion 75 moves from the first portion 942 side to the second portion 943 side past the peak portion 941 while being pressed to the case body-side fastening portion 94. Due to the second contact portion 75 moving past the peak portion 941 while being pressed to the case body-side fastening portion 94, the user can feel resistance (a clicking sensation) of such a degree that it can be understood that the peak portion 941 has been moved past.

Then, as shown in FIG. 15, after the second contact portion 75 moves past the peak portion 941, it is fastened to the second portion 942. The second contact portion 75 is fastened to the second portion 942 to such a degree that it will not be unfastened due to the weight of the cover 42. Due to the user applying force to the cover 42 so as to cause the free end 40*fb* of the cover 42 to rotate toward the case body 44, the second contact portion 75 and the second portion 942 are unfastened.

Figure 16A:
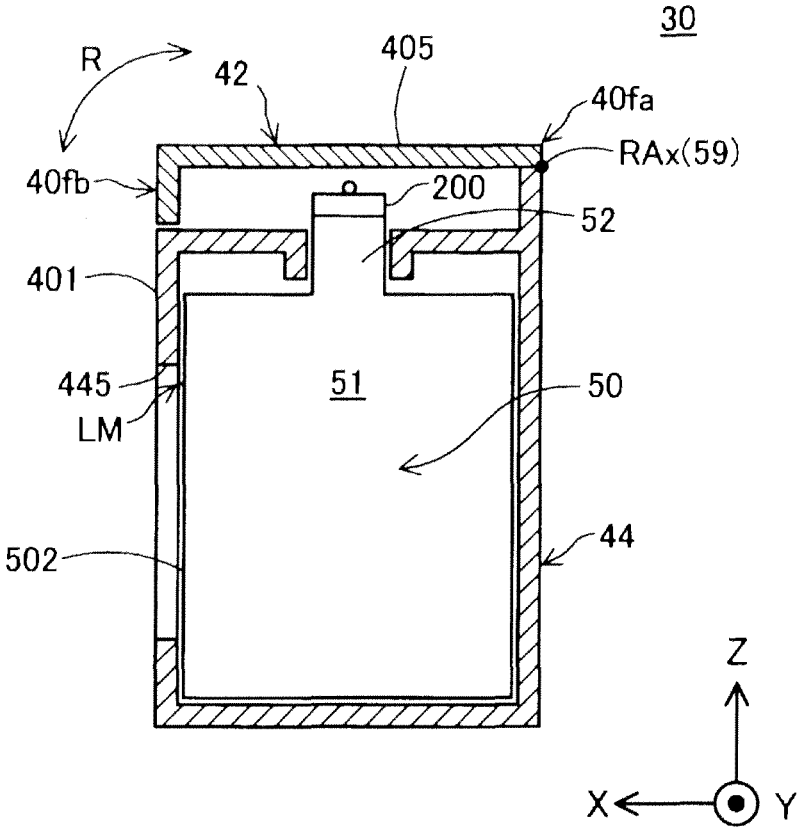
FIG. 16A is a schematic diagram for illustrating the liquid container unit.

FIG. 16A is a schematic diagram for illustrating the liquid container unit 30. The positional relationship between the visual checking portion 445 and the rotation mechanism 59 of the cover 42 will be described mainly with reference to FIG. 16A. The visual checking portion 445 is located on a first side (+X axis direction side) of the case body 44 such that the liquid injection port 52 is sandwiched in a direction along a predetermined direction (X axis direction). The rotation mechanism 59 is located on a second side (−X axis direction side) that is opposite to the first side such that the liquid injection port 52 is sandwiched in a direction along the predetermined direction. That is, the visual checking portion 445 and the rotation mechanism 59 are positioned so as to sandwich the liquid injection port in a direction along the predetermined direction. The cover 42 is opened and closed due to the free end 40*fb* located on the first side moving along the direction indicated by arrow R with the rotation axis RAx located on the axis-side end 40*fa* located on the second side being used as the fulcrum. In other words, the cover 42 is configured such that the visual checking portion 445 is not covered by the cover 42, regardless of whether the cover 42 is in the open or closed state. Accordingly, it is possible to reduce the likelihood that the visual checking portion 445 will be covered by the cover 42. For example, if the rotation mechanism 59 is located on the first side, or in other words, on the visual checking portion 445 side with respect to the liquid injection port 52, there is a possibility that the visual checking portion 445 will be obstructed by the cover 42 when the cover 42 is opened, and the visual checking portion will be difficult to see during ink injection. However, since the visual checking portion 445 is not blocked by the cover 42 as described above, the liquid surface in the liquid containing portion 51 can be checked via the visual checking portion 445 and the recognition surface 502 when the cover 42 is opened and ink is injected into the liquid containing portion 51 through the liquid injection port 52.

According to the above-described embodiment, as shown in FIG. 3, the state in which the cover 42 is closed can be held by the locking mechanism 20, and therefore it is possible to reduce the likelihood that the cover 42 will open needlessly. Accordingly, it is possible to reduce the likelihood that the ink in the liquid containing portion 51 will fly out of the case 40. Also, since the state in which the cover 42 is closed can be held by the locking mechanism 20, it is possible to reduce the likelihood that the user will unintentionally touch the liquid injection port 52. When the state in which the cover 42 is closed is being held by the locking mechanism 20, the second rotation shaft 70 side (+Y axis direction side) of the cover 42 shakes centered about the locking mechanism 20 in some cases when the user tries to open the cover 42. In the present embodiment, as shown in FIG. 8, the second length L2 is longer than the first length L1. This makes it possible to reduce the likelihood that the second rotation shaft 70 and the second shaft hole 92 will be unfastened, even when the second rotation shaft 70 side shakes. Accordingly, it is possible to reduce the likelihood that the cover 42 will come off of the case body 44.

Also, according to the above-described embodiment, as shown in FIG. 5, the liquid container unit 30 includes the attachment mechanism 400 according to which the free end 40*fb* of the cover 42 is detachably attached to the case body 44. Accordingly, it is possible to more favorably hold the state in which the cover 42 is closed. Also, according to the present embodiment, it is possible to detachably attach the free end 40*fb* to the case body 44 using a simple locking mechanism, that is, fastening between the case body-side attachment portion 842 and the cover-side attachment portion 422.

Also, according to the above-described embodiment, as shown in FIGS. 6, 7, 9, and 10, the liquid container unit 30 has the open state holding mechanism 80, according to which the state in which the cover 42 is open can be held. Accordingly, it is possible to hold the state in which the cover 42 is open. Since the open state of the cover 42 can be held, it is possible to reduce the occurrence of inconveniences such as the hand of a user being caught between the cover 42 and the case body 44 when injecting ink through the liquid injection port 52 after opening the cover 42, or the like. In the above-described embodiment, the state in which the cover 42 is open is easily held by the open state holding mechanism 80 due to the second contact portion 75 serving as the cover-side fastening portion being fastened to the second portion 943 of the case body-side fastening portion 94.

In the above-described embodiment, the first rotation shaft 60 corresponds to "other rotation portion" described in the Summary section, and the second rotation shaft 70 corresponds to "one rotation portion" described in the Summary section.

B. Second Embodiment

Figure 16B:
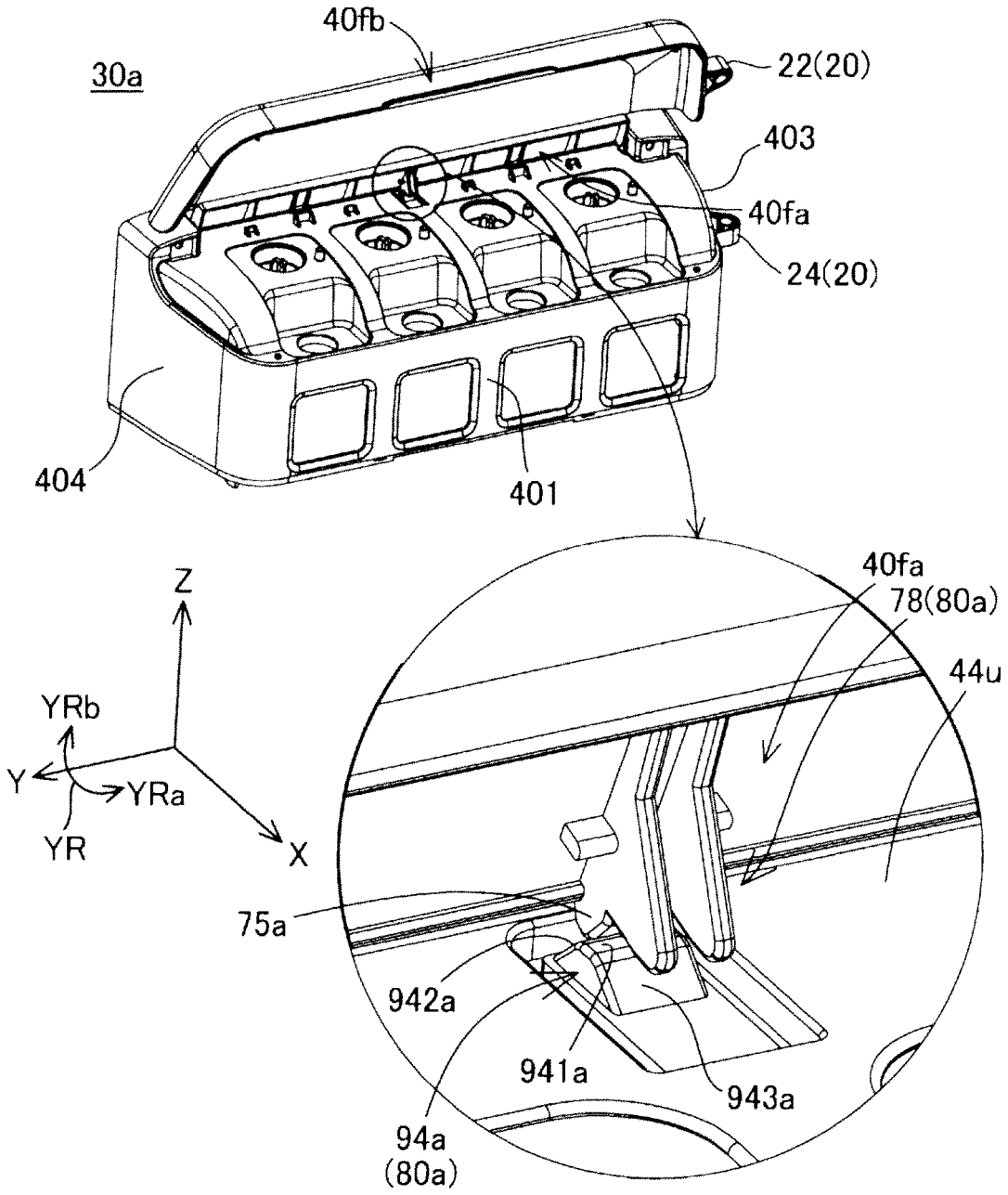
FIG. 16B is a first diagram for illustrating a liquid container unit of a second embodiment.
Figure 17:
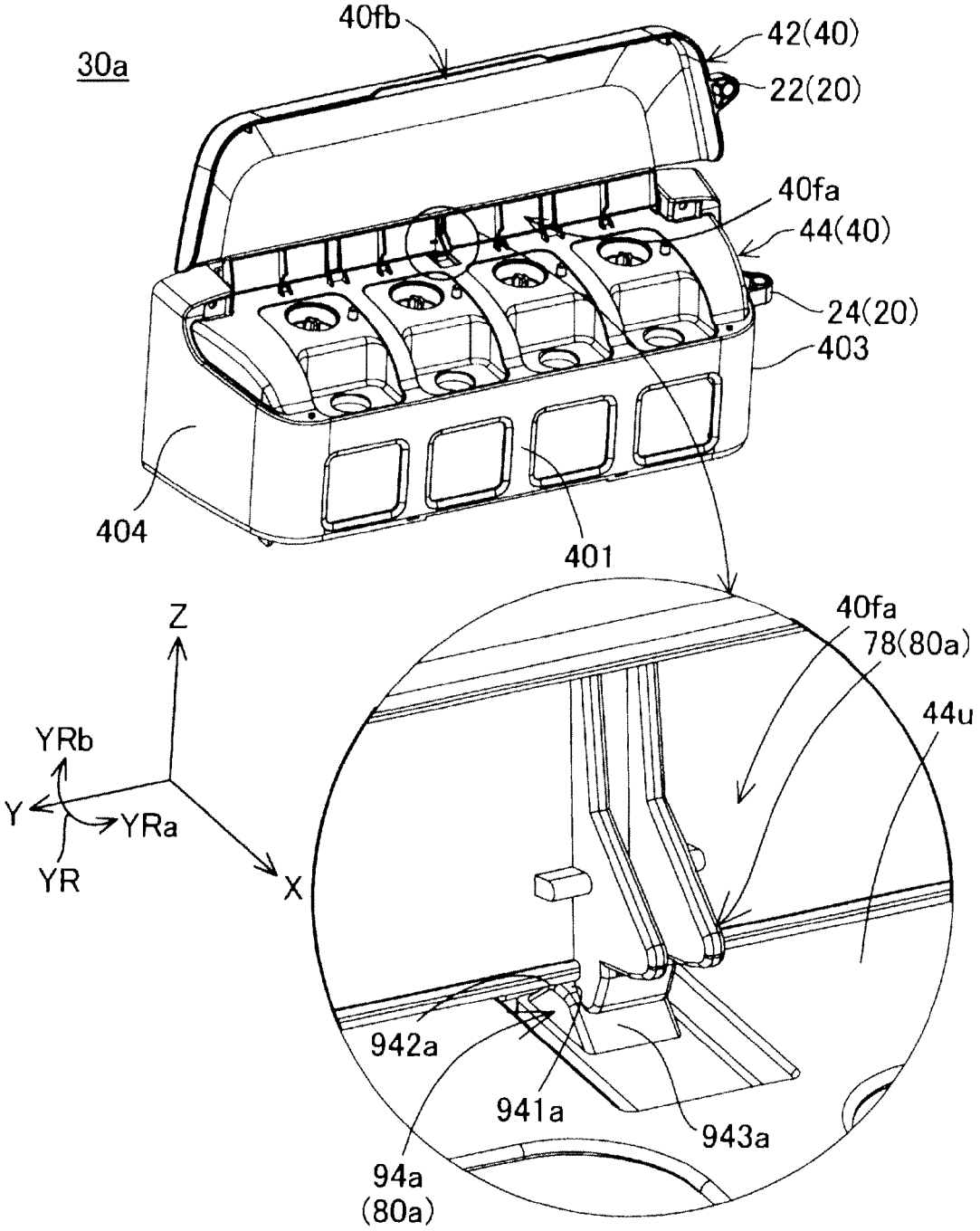
FIG. 17 is a second diagram for illustrating the liquid container unit of the second embodiment.

FIG. 16B is a first diagram for illustrating a liquid container unit 30*a* serving as a second embodiment of the invention. FIG. 17 is a second diagram for illustrating the liquid container unit 30*a* serving as the second embodiment of the invention. FIG. 16B shows an intermediate state before the cover 42 is open, and FIG. 17 shows the state in which the cover 42 is open. In FIGS. 16B and 17, the liquid containers 50 are not illustrated.

The liquid container unit 30*a* of the second embodiment and the liquid container unit 30 of the first embodiment differ in the configuration of the open state holding mechanism 80*a*, and differ in that the liquid container unit 30*a* does not include the attachment mechanism 400 (FIG. 5). Other configurations of the second embodiment are similar to those of the first embodiment, and therefore similar configurations are denoted by reference symbols identical to those of the first embodiment, and description thereof will not be included here. Also, the liquid container unit 30*a* is attached to the right side surface 106 of the printer 10, similarly to the first embodiment.

The open state holding mechanism 80*a* (FIG. 16B) includes a cover-side fastening portion 78 provided on the cover 42, and a case body-side fastening portion 94*a* provided on the case body 44. The cover-side fastening portion 78 is provided on the axis-side end 40*fa* of the cover 42. Also, the cover-side fastening portion 78 is located at the approximate center in the width direction (Y axis direction) of the case 40. The cover-side fastening portion 78 is a plate spring. The cover-side fastening portion 78 includes a second contact portion 75*a*.

The case body-side fastening portion 94*a* is a protruding member that protrudes from an upper surface 44*u* of the case body 44. The case body-side fastening portion 94*a* is approximately triangular in a cross-section orthogonal to the rotation axis direction (Y axis direction). The case body-side fastening portion 94*a* has a peak portion 941*a* that protrudes the furthest from the upper surface 44*u*, and a first portion 942*a* and second portion 943*a* that are arranged so as to sandwich the peak portion 941*a* in the rotation direction YR. The first portion 942*a* is arranged on the near side with respect to the second portion 943*a* in the opening direction YRa. The peak portion 941*a* is arranged at a location that is higher than the first and second portions 942*a* and 943*a* with respect to the upper surface 44*u*.

When the rotation mechanism 59 (FIG. 6) rotates from the state in which the cover 42 is closed to the state in which the cover 42 is open, the second contact portion 75*a* of the cover-side fastening portion 78*a* moves from the first portion 942*a* side to the second portion 943*a* side past the peak portion 941*a* while being pressed to the case body-side fastening portion 94*a*. Then, due to the second contact portion 75*a* being fastened to the second portion 943*a*, the state in which the cover 42 is open is held. The second contact portion 75*a* is fastened to the second portion 943*a* to such a degree that it will not be unfastened by the weight of the cover 42. Due to the second contact portion 75*a* moving past the peak portion 941*a* while being pressed to the case body-side fastening portion 94*a*, the user can feel a resistance (clicking sensation) of such a degree that it is possible to understand that the peak portion 941*a* has been moved past.

According to the above-described second embodiment, due to having a configuration similar to that of the first embodiment, an effect is exhibited which is similar to that of the first embodiment. For example, since the state in which the cover 42 is closed can be held by the locking mechanism 20, it is possible to reduce the likelihood that the state in which the cover 42 is open will be entered needlessly. Accordingly, it is possible to reduce the likelihood that the ink in the liquid containing portion 51 will fly out of the case 40. Also, since the state in which the cover 42 is closed can be held by the locking mechanism 20, it is possible to reduce the likelihood that the user will unintentionally touch the liquid injection port 52. Also, the state in which the cover 42 is open can be held by the open state holding mechanism 80*a*.

C. Third Embodiment

Figure 18:
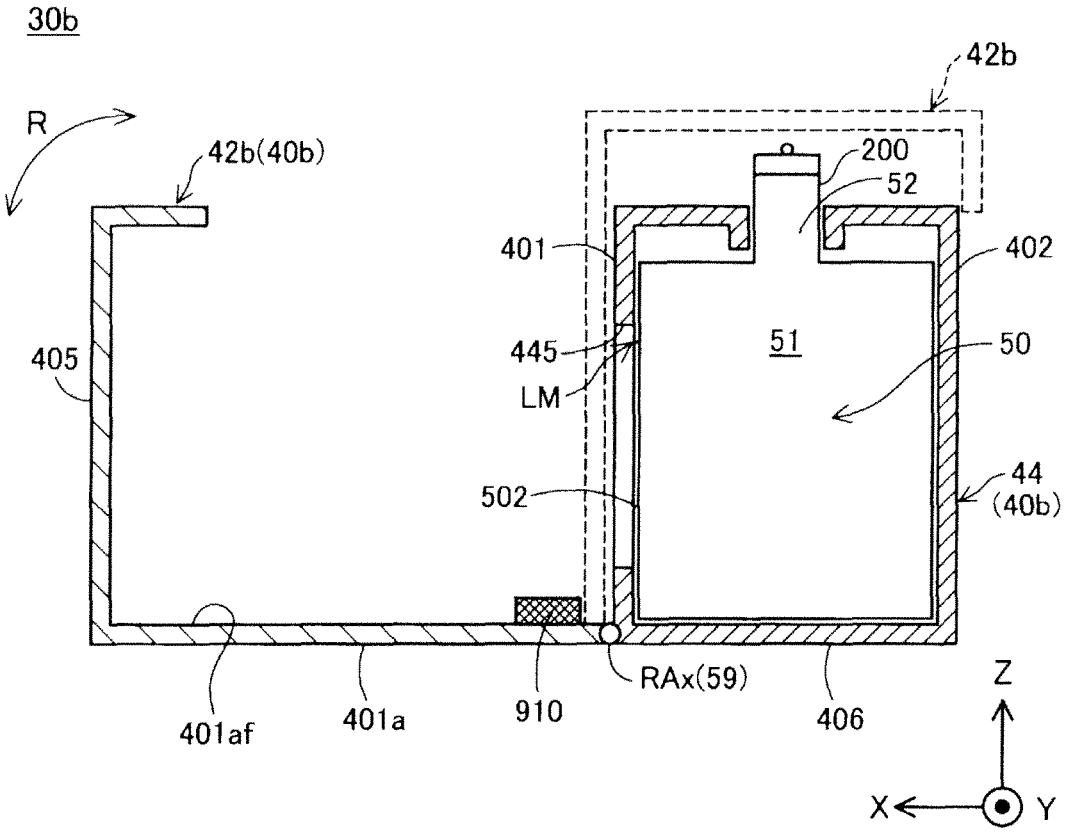
FIG. 18 is a schematic diagram for illustrating a liquid container unit serving as a third embodiment.

FIG. 18 is a schematic diagram for illustrating a liquid container unit 30*b* serving as a third embodiment of the invention. The first embodiment and the third embodiment differ in the position of the rotation mechanism 59 and the configuration of a cover 42*b*. Other configurations are similar to those of the first embodiment, and therefore similar configurations are denoted by reference numerals identical to those used in the first embodiment, and description thereof will not be included here.

In a liquid injection state of the liquid container unit 30*b*, the cover 42*b* is attached to the case body 44 by the rotation mechanism 59 such that the rotation axis RAx is formed at a location below the liquid injection port 52 and the visual checking portion 445. That is, in the liquid injection state of the liquid container unit 30*b*, the rotation mechanism 59 is located below the liquid injection port 52 and the visual checking portion 445. Also, the rotation mechanism 59 and the visual checking portion 445 are located on a first side (+X axis direction) with respect to the liquid injection port 52 in a direction along a predetermined direction (X axis direction). In the state in which the cover 42*b* is closed, the cover 42*b* covers the liquid injection port 52. In the state in which the cover 42*b* is closed, the cover 42*b* forms a case first wall 401*a* on the +X axis direction side of the case 40*b*. The case first wall 401*a* is formed with a transparent or translucent member such that the visual checking portion 445 and the upper limit portion LM are visible from the outside. In the state in which the cover 42*b* is open, the case first wall 401*a* is located below the liquid injection port 52 and the visual checking portion 445. In the present embodiment, in the state in which the cover 42*b* is open, the case first wall 401*a* extends along the horizontal direction. In the state in which the cover 42*b* is closed, a holding member 910 serving as a liquid holding member for holding ink is arranged on a surface 401*af* of the case first wall 401*a* that faces the visual checking portion 445. The holding member 910 may be a porous member such as a sponge that can hold ink, for example. The holding member 910 is located at a position of the surface 401*af* that is adjacent to the rotation mechanism 59 (end on the +X axis direction side of the sixth surface 406).

According to the above-described embodiment, when the cover 42 is opened and ink is injected through the liquid injection port 52 into the liquid containing portion 51, it is possible to receive the ink using the cover 42*b*, even if the ink accidentally flies out to the periphery of the liquid injection port 52. This makes it possible to reduce the likelihood that other portions such as the installation surface will be contaminated by ink. Also, since the holding member 910 is arranged on the surface 401*af*, ink that is spilled onto the surface 401*af* can be held by the holding member 910. Also, since the rotation mechanism 59 is located below the visual checking portion 445, it is possible to reduce the likelihood that the visual checking portion 445 will be hidden by the cover 42*b* when the cover 42 is opened and ink is injected through the liquid injection port 52. Accordingly, when the cover 42 is opened and ink is injected into the liquid containing portion 51 through the liquid injection port 52, the liquid surface in the liquid containing portion 51 can be checked via the visual checking portion 445 and the recognition surface 502.

In the above-described embodiment, the holding member 910 can be omitted. Also, in the X axis direction, the rotation mechanism 59 was located on a side (+X axis direction side) on which the visual checking portion 445 is located with respect to the liquid injection port 52, but there is no limitation to this. For example, the rotation mechanism 59 may be arranged on a side opposite to the side on which the visual checking portion 445 is located, such that the liquid injection port 52 is sandwiched in the X axis direction. With this kind of configuration as well, ink that flies out to the periphery when ink is injected through the liquid injection port 52 can be received by the cover 42*b*, similarly to the above-described embodiment.

D. Variations

Note that the invention is not limited to the above-described examples and embodiments and can be carried out in various modes without straying from the gist thereof, and variations such as the following are also possible.

D-1. First Variation

In the above-described embodiments, the locking mechanism 20 included the padlock 21, the first insertion portion 22, and the second insertion portion 24 (FIG. 3), but another configuration is possible as long as it is a configuration according to which the state in which the cover 42 is closed can be held by locking. For example, the locking mechanism 20 may be such that a lock is provided on the case 40 itself.

D-2. Second Variation

In the above-described first embodiment, the attachment mechanism 400 used a method of fixing using the elasticity of a material, but there is no limitation to this, and it is sufficient to use a configuration in which the free end 40*fb* of the cover 42 is detachably attached to the case body 44. For example, the attachment mechanism 400 may include a cover-side magnet provided on the cover 42, and a case body-side magnet provided on the case body 44 so as to attract the cover magnet. Also, the attachment mechanism 400 may have a configuration in which double-sided tape is provided on at least one of the cover 42 and the case body 44. Also, the attachment mechanism 400 may be a surface fastener. In the case of using a hook-and-loop fastener, a member raised in the form of hooks may be provided on one of the case body 44 and the cover 42, and a member raised in the form of loops may be provided on the other. Also, the liquid container unit 30*a* of the second embodiment may include the attachment mechanism 400.

D-3. Third Variation

In the above-described embodiments, the positional relationship between the first rotation shaft 60 and the second rotation shaft 70 may be reversed. In this case, the positional relationship between the displacement portion 84 and the case body-side fastening portion 94 is also reversed.

D-4. Fourth Variation

In the above-described embodiment, as shown in FIG. 8, the cover 42 included the rotation mechanism 59, which includes the rotation shaft (first shaft body 62 and second shaft body 72), but as long as a configuration is used in which the cover 42 is rotated, the shaft need not be included. For example, the rotation shaft may be formed on the case body 44 side, and the cover 42 may include a shaft hole that receives the rotation shaft of the case body 44.

D-5. Fifth Variation

In the above-described embodiment, the liquid container unit 30 was arranged outside of the housing 12 (FIG. 1), but the liquid container unit 30 may be arranged inside of the housing 12. In this case, the case 40 of the liquid container unit 30 is attached to the inner wall surface of the housing 12, for example. Also, a portion of the housing 12 may be openably/closeably configured such that the liquid container unit 30 can be operated from the outside of the housing 12. Accordingly, it is possible to open and close the cover 42 and inject the ink through the liquid injection port 52. Also, the case 42 may be formed integrally with the housing 12.

D-6. Sixth Variation

In the above-described embodiment, the plug member 200 for tightly closing the liquid injection port 52 was provided independently of the cover 42 (FIG. 4), but there is no limitation to this. For example, the cover 42 may include the plug member 200. Specifically, the plug member 200 is included on a side (surface) opposing the liquid injection port 52 of the cover 42. Accordingly, it is possible to reduce the likelihood that the plug member 200 will be lost. Also, if the plug member 200 is provided on the opposing side, it is preferable that the plug member is provided at a location at which the plug member 200 can be attached to and detached from the liquid injection port 52 by opening and closing the cover 42. Specifically, in the state in which the cover 42 is closed, the liquid injection port 52 is closed due to the plug member 200 being attached to the liquid injection port 52, and the plug member 200 is removed from the liquid injection port 52 by opening the cover 42. By doing so, the plug member 200 can be attached to and detached from the liquid injection port 52 by opening and closing the cover 42, and therefore the operation step in which ink is injected through the liquid injection port 52 can be shortened. Also, when the plug member 200 is attached to or detached from the liquid injection port 52, the user does not need to touch the plug member 200, and it is therefore possible to reduce the likelihood that the user's hand will be contaminated by ink.

D-7. Seventh Variation

In the above-described embodiment, the upper limit portion LM was provided on the recognition surface 502, but instead of this, it is possible to provide the recognition surface 502 with a lower limit portion LP for recognizing that the amount of ink in the liquid containing portion 51 has become small, and it is possible to provide both the upper limit portion LM and the lower limit portion LP. The lower limit portion LP has a horizontal linear portion, similarly to the upper limit portion LM. Using the fact that the ink surface has reached the linear portion as a guide, the user replenishes the ink in the liquid containing portion 51.

D-8. Eighth Variation

In the above-described embodiments, the liquid containing units 30 and 30*a* included the liquid container 50 for supplying ink to the printer 10 and the case 40 for containing the liquid container 50, but the invention may be applied to a liquid container containing another liquid and a liquid consumption apparatus that consumes the other liquid. Liquid consuming apparatuses in which a liquid container containing another liquid is used are listed below.

(1) An image recording apparatus such as a facsimile apparatus (2) A color material ejecting recording apparatus used in manufacturing of a color filter for use in an image display apparatus such as a liquid crystal display (3) An electrode material ejecting apparatus used for forming electrodes in an organic EL (Electroluminescence) display, a field emission display (FED), or the like (4) A liquid consuming apparatus that ejects a liquid containing biological organic matter used in bio-chip manufacturing (5) A sample ejecting apparatus serving as a precision pipette (6) A lubricant ejecting apparatus (7) A resin liquid ejecting apparatus (8) A liquid consuming apparatus that ejects a lubricant at a pinpoint in a precision machine such as a clock or a camera (9) A liquid consuming apparatus that ejects a transparent resin liquid such as ultraviolet-curable resin liquid onto a substrate in order to form fine semispherical lenses (optical lenses) or the like to be used in an optical communication element or the like

(10) A liquid consuming apparatus that ejects an acidic or basic etching liquid in order to etch a substrate or the like

(11) A liquid consuming apparatus including a liquid consuming head that discharges a very small amount of another kind of droplet Note that "droplet" indicates a state of a liquid discharged from a liquid consuming recording apparatus or a liquid consuming apparatus, and also includes droplets that leave traces in the form of particles, in a tear shape, and in a threadlike shape. Also, "liquid" in the context used here need only be a material that can be sprayed as a liquid by a liquid consuming recording apparatus or a liquid consuming apparatus. For example, a "liquid" need only be a material in a state in which a substance is in the liquid phase, and "liquid" also encompasses materials in a liquid state with a high or low viscosity, and materials in a liquid state such as sols, gels, other inorganic solvents, organic solvents, solutions, liquid resin, and liquid metals (metallic melts). Moreover, "liquid" encompasses not only a liquid as a state of a substance, but also liquids obtained by dissolving, dispersing, or mixing particles of a functional material composed of solid matter such as a pigment or metallic particles in a solvent, and the like. Moreover, representative examples of liquids include inks such as those described in the embodiments above, and liquid crystal. Here, it is assumed that ink encompasses various types of liquid compositions, such as general aqueous ink, oil-based ink, gel ink, and hot melt ink. Moreover, if UV ink that can be cured by emission of ultraviolet light is contained in the liquid containing portion and connected to a printer, the liquid container floats from the installation surface, and therefore the likelihood that curing will occur due to the heat from the installation surface being transmitted to the liquid containing portion is reduced.

D-9. Ninth Variation

The invention is not limited to the above-described embodiments and variations and can be realized with various configurations without straying from the gist thereof. For example, the technical features of the embodiments and variations that correspond to the technical features described in the Summary can be replaced or combined as appropriate in order to resolve a portion or all of the above-described problems, or in order to achieve a portion or all of the above-described effects. Moreover, if a technical feature is not described in the specification as being essential, it can be omitted as appropriate.

What is claimed is:

1. A liquid container unit for supplying a liquid to a liquid consuming apparatus, comprising:

a liquid container including a liquid containing portion configured to contain the liquid to be supplied to the liquid consuming apparatus, and a liquid injection port through which the liquid is injected into the liquid containing portion;

a case body configured to contain the liquid container such that at least a portion of the liquid injection port is located outside the case body;

a cover that includes a rotation mechanism, the cover being attached to the case body so as to be able to open and close by means of the rotation mechanism, and covering the liquid injection port in a closed state; and a locking mechanism configured to hold the closed state by means of locking, wherein the rotation mechanism includes:

a first rotation portion configured to engage with the case body; and a second rotation portion configured to engage with the case body at a position located farther from the locking mechanism than the first rotation portion is in a rotation axis direction of the rotation mechanism, and a second length of an engaging portion at which the case body and the second rotation portion are engaged is longer than a first length of an engaging portion at which the case body and the first rotation portion are engaged.

2. The liquid container unit according to claim 1, further comprising an attachment mechanism for detachably attaching a free end of the cover located on a side opposite to a side on which the rotation mechanism is located to the case body.

3. The liquid container unit according to claim 2, wherein the attachment mechanism includes a case body-side attachment portion provided on the case body and a cover-side attachment portion that is provided on the free end of the cover and is fastened to the case body-side attachment portion.

4. The liquid container unit according to claim 1, further comprising an open state holding mechanism configured to hold a state in which the cover is open.

5. The liquid container unit according to claim 4, wherein the open state holding mechanism includes:

a cover-side fastening portion provided on the cover; and a protruding case body-side fastening portion that is provided on the case body, is configured to hold the state in which the case body is open due to the cover-side fastening portion being fastened thereto, and includes a peak portion, and a first portion and a second portion that are positioned so as to sandwich the peak portion in the rotation direction of the rotation mechanism, and when the rotation mechanism is rotated from the state in which the cover is closed to the state in which the cover is open, the cover-side fastening portion moves from the first portion side to the second portion side past the peak portion and is fastened to the second portion, and thus the state in which the cover is open is held.

6. The liquid container unit according to claim 5, wherein one rotation portion of the first rotation portion and the second rotation portion includes the cover-side fastening portion, the open state holding mechanism includes:

the first and second rotation portions; and a displacement portion that is provided on the case body and is configured to, when the rotation mechanism rotates from the state in which the cover is closed to the state in which the cover is open, displace the rotation mechanism from the other above-referenced rotation portion side to the one rotation portion side in the rotation axis direction, the displacement portion has a protruding shape that protrudes from the other above-referenced rotation portion to the one rotation portion in the rotation axis direction, and letting a direction in which the rotation mechanism rotates from the state in which the cover is closed to the state in which the cover is open be an opening direction, when the rotation mechanism rotates in the opening direction, a portion of the other above-referenced rotation portion moves onto the displacement portion, whereby the rotation mechanism is displaced from the other above-referenced rotation portion side to the one rotation portion side in the rotation axis direction, and the cover-side fastening portion moves from the first portion side to the second portion side past the peak portion while being pressed to the case body-side fastening portion by the displacement of the rotation mechanism so as to be fastened to the second portion.

7. A liquid container unit for supplying a liquid to a liquid consuming apparatus, comprising:

a liquid container including a liquid containing portion configured to contain the liquid to be supplied to the liquid consuming apparatus, and a liquid injection port through which the liquid is injected into the liquid containing portion;

a case body configured to contain the liquid container such that at least a portion of the liquid injection port is located outside the case body, the case body having a first lateral surface and a second lateral surface opposite the first lateral surface; and a cover that includes a rotation mechanism, the cover being attached to the case body so as to be able to open and close by means of the rotation mechanism, and covering the liquid injection port in a closed state, wherein the case body includes a visual checking portion that is located on a first lateral surface side of the liquid injection port, and according to which a liquid surface in the liquid containing portion is visible from outside, and wherein the rotation mechanism is located on a second lateral surface side of the liquid injection port.

8. The liquid container unit according to any one of claim 7, wherein the cover includes a plug member configured to tightly close the liquid injection port on a side opposing the liquid injection port of the cover.

9. A liquid container unit for supplying a liquid to a liquid consuming apparatus, comprising:

a liquid container including a liquid containing portion configured to contain the liquid to be supplied to the liquid consuming apparatus, and a liquid injection port through which the liquid is injected into the liquid containing portion;

a case body configured to contain the liquid container such that at least a portion of the liquid injection port is located outside the case body; and a cover that includes a rotation mechanism, the cover being attached to the case body so as to be able to open and close by means of the rotation mechanism, and covering the liquid injection port in a closed state, wherein the case body includes a visual checking portion that is located on a first lateral surface side of the liquid injection port, and according to which a liquid surface in the liquid containing portion is visible from outside, wherein the rotation mechanism is located below the liquid injection port and the visual checking portion in a liquid injection state of the liquid container unit when a liquid is injected into the liquid containing portion through the liquid injection port.

10. The liquid container unit according to claim 9, wherein the cover includes a liquid holding portion.

11. The liquid container unit according to claim 10, wherein the liquid holding portion comprises a porous member.

* * * * *